US010203621B2

(12) United States Patent
Miyajima et al.

(10) Patent No.: US 10,203,621 B2
(45) Date of Patent: Feb. 12, 2019

(54) IMAGE FORMING METHOD AND TONER SET FOR DEVELOPING ELECTROSTATIC LATENT IMAGE

(71) Applicant: Konica Minolta, Inc., Tokyo (JP)

(72) Inventors: Kenshi Miyajima, Hino (JP); Noboru Ueda, Mitaka (JP); Kouji Sugama, Musashino (JP); Natsuki Ito, Hachioji (JP); Yohei Ohno, Hino (JP); Hidehito Haruki, Asaka (JP); Keisuke Asano, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/820,580

(22) Filed: Nov. 22, 2017

(65) Prior Publication Data

US 2018/0157186 A1 Jun. 7, 2018

(30) Foreign Application Priority Data

Dec. 2, 2016 (JP) ..... 2016-235183

(51) Int. Cl.

| | |
|---|---|
| ***G03G 9/087*** | (2006.01) |
| ***G03G 13/01*** | (2006.01) |
| ***G03G 9/09*** | (2006.01) |
| ***G03G 9/08*** | (2006.01) |

(52) U.S. Cl.

CPC ..... *G03G 9/08755* (2013.01); *G03G 9/0804* (2013.01); *G03G 9/0815* (2013.01); *G03G 9/08711* (2013.01); *G03G 9/091* (2013.01); *G03G 9/0904* (2013.01); *G03G 9/0918* (2013.01); *G03G 13/013* (2013.01)

(58) Field of Classification Search

CPC .. G03G 13/013; G03G 13/01; G03G 9/08711; G03G 9/08755; G03G 9/0904; G03G 9/0918

USPC .. 430/107.1, 45.51, 45.5, 45.1, 45.53, 109.4

See application file for complete search history.

(56) References Cited

U.S. PATENT DOCUMENTS 8,652,719 B2 * 2/2014 Uchinokura ..... G03G 9/0804 430/107.1
9,891,555 B2 * 2/2018 Hara ..... G03G 15/0865

FOREIGN PATENT DOCUMENTS

JP 2008090054 A 4/2008

* cited by examiner

*Primary Examiner* — Janis L Dote
(74) *Attorney, Agent, or Firm* — Lucas & Mercanti, LLP

(57) ABSTRACT

An image forming method includes using yellow toner, magenta toner, cyan toner, and black toner in which each of the yellow toner, the magenta toner, the cyan toner, and the black toner includes a crystalline polyester resin having a constitutional unit derived from a linear chain aliphatic diol, an amorphous resin, a colorant, and a releasing agent. A carbon number of a linear chain aliphatic diol component forming the crystalline polyester resin contained in the black toner is 6 or more, and a carbon number of a linear chain aliphatic diol component forming the crystalline polyester resin contained in each of the yellow toner, the magenta toner, and the cyan toner is 3 or more and 5 or less.

16 Claims, No Drawings

IMAGE FORMING METHOD AND TONER SET FOR DEVELOPING ELECTROSTATIC LATENT IMAGE

CROSS-REFERENCE TO RELATED APPLICATION

This application is based on Japanese patent application no. 2016-235183 filed on Dec. 2, 2016, the contents of which are incorporated herein by reference.

BACKGROUND

1. Technological Field

The present invention relates to an image forming method and a toner set for developing an electrostatic latent image.

2. Description of the Related Art

In recent years, from the viewpoint of having high speed and saving energy, a toner with excellent low temperature fixability is required to fix a toner image by using less energy than before. To decrease the fixing temperature of a toner, it is necessary to lower the melting temperature or melting viscosity of a binder resin for constituting the toner. To meet those requirements, development of a toner containing crystalline resin with excellent melting properties is currently in progress.

In JP 2008-90054 A, for example, a toner set in which a crystalline polyester resin is used as a binder resin for toner of each color is suggested. When a crystalline polyester resin is introduced to a toner like that, heat melting of a toner can occur at low temperature, and as a result, the low temperature fixability is enhanced.

SUMMARY

However, the inventors of the present invention found that, when a full color image is formed by a toner set in which a crystalline polyester resin is used as a binder resin for toner of each color like JP 2008-90054 A, a problem occurs in that a decrease in image quality is caused due to image noise (fog) or image density of a full color image depends on the environment, or the like. As such, a technique enabling suppression of image noise while having low temperature fixability, and also lowering of the environment dependent property of image density of a full color image has been in demand.

Accordingly, object of the present invention is to provide a means for suppressing image noise and lowering the environment dependent property of image density of a full color image while maintaining favorable low temperature fixability.

In view of the problems that are described above, the inventors of the present invention conducted intensive studies. As a result, it was found that the above object can be achieved by the following constitutions. In order to achieve at least one of the aforementioned objects, the image forming method to which one aspect of the present invention is reflected has the following constitution. An image forming method using yellow toner, magenta toner, cyan toner, and black toner in which each of the yellow toner, the magenta toner, the cyan toner, and the black toner includes a crystalline polyester resin having a constitutional unit derived from a linear chain aliphatic diol, an amorphous resin, a colorant, and a releasing agent, a carbon number of a linear chain aliphatic diol component forming the crystalline polyester resin contained in the black toner is 6 or more, and a carbon number of a linear chain aliphatic diol component forming the crystalline polyester resin contained in each of the yellow toner, the magenta toner, and the cyan toner is 3 or more and 5 or less.

The inventors of the present invention further found that the aforementioned object can be achieved by the following constitution. In order to achieve at least one of the aforementioned objects, the toner set for developing an electrostatic latent image in which one aspect of the present invention is reflected has the following constitution. A toner set for developing an electrostatic latent image including yellow toner, magenta toner, cyan toner, and black toner in which each of the yellow toner, the magenta toner, the cyan toner, and the black toner includes a crystalline polyester resin having a constitutional unit derived from a linear chain aliphatic diol, an amorphous resin, a colorant, and a releasing agent, a carbon number of a linear chain aliphatic diol component forming the crystalline polyester resin contained in the black toner is 6 or more, and a carbon number of a linear chain aliphatic diol component forming the crystalline polyester resin contained in each of the yellow toner, the magenta toner, and the cyan toner is 3 or more and 5 or less.

DETAILED DESCRIPTION

Hereinbelow, one or more embodiments of the present invention will be explained. However, the scope of the present invention is not limited to the disclosed embodiments.

The first embodiment of the present invention is an image forming method using yellow toner, magenta toner, cyan toner, and black toner in which each of the yellow toner, the magenta toner, the cyan toner, and the black toner contains a crystalline polyester resin having a constitutional unit derived from a linear chain aliphatic diol, an amorphous resin, a colorant, and a releasing agent, a carbon number of a linear chain aliphatic diol component forming the crystalline polyester resin contained in the black toner is 6 or more, and a carbon number of a linear chain aliphatic diol component forming the crystalline polyester resin contained in each of the yellow toner, the magenta toner, and the cyan toner is 3 or more and 5 or less.

Furthermore, the second embodiment of the present invention is a toner set for developing an electrostatic latent image containing yellow toner, magenta toner, cyan toner, and black toner in which each of the yellow toner, magenta toner, cyan toner, and black toner contains a crystalline polyester resin having a constitutional unit derived from a linear chain aliphatic diol, an amorphous resin, a colorant, and a releasing agent, a carbon number of a linear chain aliphatic diol component forming the crystalline polyester resin contained in the black toner is 6 or more, and a carbon number of a linear chain aliphatic diol component forming the crystalline polyester resin contained in each of the yellow toner, the magenta toner, and the cyan toner is 3 or more and 5 or less.

Furthermore, the toner set described herein indicates a combination of toners for forming different image forming layers when transferred on a recording medium.

According to the image forming method and toner set for developing an electrostatic latent image of the present invention, a carbon number of a linear chain aliphatic diol component forming the crystalline polyester resin that is contained in the toner with each color is within a specific range. By having this constitution, the image noise can be suppressed and the environment dependent property of image density of a full color image can be lowered while favorable low temperature fixability is maintained according to the image forming method of the present invention. Furthermore, the same effect as above is also obtained when the toner set for developing an electrostatic latent image of the present invention is used. Although the mechanism for obtaining the above effect based on the constitution of the present invention remains unclear, it is considered as follows.

As it is disclosed in JP 2008-90054 A, a toner containing a crystalline polyester resin has excellent low temperature fixability. However, by having low electric resistance, the crystalline polyester resin may cause a deteriorated charging property of a toner when it is used as a binder resin for toner. From such point of view, it is considered that, since a colorant in a black toner such as carbon black, in particular, has low electric resistance (high conductivity), a black toner cannot maintain the insulating property during application of electric field for transfer so that the transfer property is easily impaired. Furthermore, such an impairment of transfer property can easily occur in a high temperature and high humidity environment in which the charging property may easily deteriorate. Meanwhile, according to a color toner other than a black toner (a yellow toner, a magenta toner, and a cyan toner; in the present specification, they are also simply referred to as a "color toner"), the colorant contained in the toner has high electric resistance (low conductivity), and thus the color toner has a higher charging property compared to a black toner. As such, under a low temperature and low humidity environment in which a higher charging property is easily obtained, the charging amount of a color toner becomes excessively high so that the color toner is likely to electrostatically adhere on an intermediate transfer body during transfer. As a result, it becomes difficult for the color toner to get transferred from an intermediate transfer body to a recording medium like paper.

For the reasons that are described above, it is expected that, when a full color image is formed by using a toner containing a crystalline polyester resin like JP 2008-90054 A, the transfer property has high environment dependent property, and as a result, it would be difficult to obtain a full color image with favorable image density.

In this regard, by having the carbon number of a linear chain diol component as a constitutional unit of the crystalline polyester resin that is contained in each of a black toner and a color toner set within a specific range as described in the present invention, the charging property of a black toner and a color toner can be controlled. Namely, it is possible to enhance the charging property of a black toner in a high temperature and high humidity environment and, at the same time, suppress an excessive increase in the charging property of a color toner in low temperature and low humidity environment.

Specifically, as the carbon number of a linear chain diol component (hereinbelow, also described as "$C_{Bk}$"), which is a constitutional unit of the crystalline polyester resin to be contained in a black toner, is set to be 6 or more, it becomes easier for the crystalline polyester resin to incorporate into the inside of a toner particle. As a result, a decrease in electric resistance is suppressed on a surface of a toner particle so that the charging property of a black toner can be increased. On the other hand, if $C_{Bk}$ is less than 6, the crystalline polyester resin can be easily exposed on a surface of a toner particle so that a decrease in charging property on a surface of a toner particle is caused. Accordingly, the charging property in high temperature and high humidity environment becomes insufficient, in particular, and thus favorable image density cannot be achieved.

Herein, easy incorporation of the crystalline polyester resin into a toner particle can be explained as follows. When the carbon number of a linear chain diol component forming the crystalline polyester resin is large, fewer hydroxyl groups may be present at the end of the crystalline polyester resin compared to a crystalline polyester resin which is formed with a linear chain diol component having small carbon number. In that case, the aggregation stability obtained by hydroxyl groups of the crystalline polyester resin is lowered, and thus it is considered that, as it becomes difficult for the crystalline polyester resin to be present alone, the resin can be easily incorporate into a toner particle. Thus, a crystalline polyester resin which has a linear chain diol component with large carbon number as a constitutional unit can be easily present at the center instead of a near surface region of a toner particle. This tendency may become more significant when a toner particle is formed by an emulsion aggregation method.

Furthermore, according to the present invention, as the carbon number of a linear chain diol component (hereinbelow, also described as "$C_{Ye}$", "$C_{Ma}$", and "$C_{Cy}$", respectively), which is a constitutional unit of the crystalline polyester resin to be contained in each color toner, is set to be 5 or less, it becomes easier for the crystalline polyester resin to get exposed on a surface of a toner particle. As a result, the electric resistance on a surface of a toner particle is lowered to suitable level so that excess charging of a color toner can be suppressed. Meanwhile, if $C_{Ye}$, $C_{Ma}$, and $C_{Cy}$ are more than 5, it becomes easier for the crystalline polyester resin to incorporate into the inside of a toner particle. As a result, especially, excessive charging on a surface of a toner particle in low temperature and low humidity environment is not suppressed, and thus favorable image density cannot be achieved.

In the course of studies, the inventors of the present invention also paid attention to image noise (fog) which occurs during image forming by using a toner containing a crystalline polyester resin. To deal with that problem, the inventors conducted further studies. Although the accurate mechanism therefor remains unclear, it is considered that image noise occurs based on the following mechanism. Namely, it is considered that, as $C_{Ye}$, $C_{Ma}$, and $C_{Cy}$ of the color toner according to the present invention is 5 or less, a decrease in image density can be suppressed even in low temperature and low humidity environment, and if $C_{Ye}$, $C_{Ma}$, and $C_{Cy}$ are too small, image noise is occurred by the presence of an excess amount of crystalline polyester resin near the surface of a toner particle. More specifically, in high temperature and high humidity environment and/or under low printing ratio condition, the crystalline polyester resin present on a surface of a toner particle may easily melt under the influence of temperature and humidity and/or the influence of stirring stress within a developing apparatus. As a result, the amorphous resin present near the crystalline polyester resin is excessively plasticized, yielding an occurrence of aggregated toner particles. It is further expected that, because it is difficult to support the aggregated toner particles on a carrier, toner scattering occurs so that toner fogging (image noise) to white area of an image is caused.

In this regard, according to the present invention, as $C_{Ye}$, $C_{Ma}$, and $C_{Cy}$ are 3 or more, presence of an excess amount of the crystalline polyester resin on a surface of a color toner particle can be suppressed. As such, the toner particle aggregation accompanied with excessive plasticization of an amorphous resin described above is suppressed so that an occurrence of image noise can be suppressed.

Thus, according to the present invention, the environment dependent property of image density of a full color image can be reduced while maintaining the low temperature fixability, and an occurrence of image noise can be also suppressed based on the mechanism described above.

Furthermore, the above mechanism is based on pure assumption, and the present invention is not limited to the above mechanism at all.

Hereinbelow, embodiments for carrying out the present invention are explained in detail. Furthermore, the present invention is not limited to the following embodiments. Furthermore, in the present specification, the expression "X to Y" representing a range means "X or more and Y or less" including X and Y. Furthermore, unless specifically described otherwise, the operations and measurements of physical properties are carried out under conditions of room temperature (25° C.)/relative humidity of 40 to 50% RH.

The image forming method and toner set for developing an electrostatic latent image according to the present invention have characteristics in each toner as described above. As such, constitution of each toner is explained first in detail hereinbelow.

<Toner (Toner for Developing Electrostatic Latent Image)>

Each of the black toner and each color toner according to the present invention contains a crystalline polyester resin, an amorphous resin, a colorant corresponding to each color, and a releasing agent. The "toner" according to the present invention indicates a group of "toner particle".

[Toner Particle]

The toner particle constituting the toner of the present invention contains a crystalline polyester resin having a constitutional unit derived from a linear chain aliphatic diol, an amorphous resin, a colorant corresponding to each color, and a releasing agent. Furthermore, if necessary, the toner particle may also contain other component for constituting a toner like charge control agent. Hereinbelow, explanations are given for each component constituting the toner particle.

<<Crystalline Polyester Resin>>

The toner particle contains a crystalline polyester resin as a binder resin. Thus, upon fixing by heating, the crystalline polyester resin is compatible with amorphous resin so that the low temperature fixability of a toner can be enhanced.

The crystalline polyester resin is indicates a polyester resin which has a distinct endothermic peak rather than stair-like endothermic change in differential scanning calorimetry (DSC). The distinct endothermic peak specifically means a peak which has the half width of endothermic peak of 15° C. or lower, when the measurement by differential scanning calorimetry (DSC) is carried out with temperature increase rate of 10° C./minute.

Melting point (Tm) of the crystalline polyester resin is preferably 55 to 90° C., and more preferably 70 to 88° C. As the melting point of the crystalline polyester resin is within a range of 55 to 90° C., sufficient low temperature fixability is obtained. Furthermore, the melting point of the crystalline polyester resin can be controlled based on the resin composition. The melting point (Tm) of the crystalline polyester resin can be measured by an apparatus of differential scanning calorimetry (DSC), and specifically, it is measured according to the method described in Examples. Furthermore, the melting point can be controlled by a person skilled in the pertinent art on the basis of the resin composition.

The crystalline polyester resin is obtained by a polycondensation reaction between linear chain aliphatic alcohol and di- or higher carboxylic acid (polyhydric acid). Furthermore, as long as the effect of the present invention is not impaired, it is also possible to use di- or higher hydric alcohol (polyhydric alcohol).

Examples of the linear chain aliphatic diol and polycarboxylic acid which are used for preparation of the crystalline polyester resin include the followings.

(Linear Chain Aliphatic Diol)

The linear chain aliphatic diol that is used for preparation of the crystalline polyester resin to be contained in the black toner has carbon number of 6 or more. As such, a linear chain aliphatic diol like 1,6-hexane diol, 1,7-heptane diol, 1,8-octane diol, 1,9-nonane diol, 1,10-decane diol, 1,11-undecane diol, 1,12-dodecane diol, 1,13-tridecane diol, and 1,14-tetradecane diol can be used, for example. It is also possible to use a derivative thereof. The linear chain aliphatic diol may be used either singly or as a mixture of two or more kinds thereof.

Upper limit of the carbon number of the linear chain aliphatic diol ($C_{Bk}$) is not particularly limited. However, considering the easy availability, easiness for preparation of a crystalline polyester resin, and melting point of the obtained crystalline polyester resin, it is preferably 20 or less. By having the carbon number ($C_{Bk}$) of 20 or less, the abundance of the crystalline polyester resin on a surface of a toner particle can be obtained at a suitable level. As a result, the amorphous resin present on a surface of a toner particle is plasticized at suitable level and fusion between toner particles or fusion between toner particle and recording medium like paper can be easily obtained, and thus favorable low temperature fixability can be exhibited. Furthermore, for improving the low temperature fixability, the carbon number of the linear chain aliphatic diol component ($C_{Bk}$) forming the crystalline polyester resin contained in the black toner is preferably 6 or more and 12 or less, more preferably 6 or more and 9 or less, and particularly preferably 6 or more and 7 or less.

The linear chain aliphatic diol used for preparation of the crystalline polyester resin contained in each color toner has a carbon number of 3 or more and 5 or less. As such, at least one linear chain aliphatic diol selected from a group consisting of 1,3-propane diol, 1,4-butane diol, and 1,5-pentane diol can be used. Furthermore, a derivative thereof can be also used.

The carbon number of the linear chain aliphatic diol ($C_{Ye}$, $C_{Ma}$, and $C_{Cy}$) is more preferably 4 or 5 from the viewpoint of further suppression of the image noise. That is, the carbon number of the linear chain aliphatic diol component forming the crystalline polyester resin contained in each of the yellow toner, the magenta toner, and the cyan toner is preferably 4 or 5.

Furthermore, as long as the effect of the present invention is not impaired, it is also possible to use di- or higher hydric alcohol (polyhydric alcohol) other than the linear chain aliphatic diol described above. Examples of the polyhydric alcohol include glycerin, pentaerythritol, trimethylol propane, and sorbitol. However, for the black toner, from the viewpoint of having easy control of the charging property of a toner particle based on easy incorporation of the crystalline polyester resin into the inside of a toner particle, the polyhydric alcohol component forming the crystalline polyester resin preferably consists of the aforementioned linear chain aliphatic diol having a carbon number of 6 or more. Furthermore, for the color toner, from the viewpoint of having easy control of the charging property of a toner particle based on easy exposure of the crystalline polyester resin on a surface of a toner particle, the polyhydric alcohol component forming the crystalline polyester resin preferably consists of the aforementioned linear chain aliphatic diol having a carbon number of 3 or more and 5 or less.

The amount of the linear chain aliphatic diol forming the crystalline polyester resin, which is contained in each of the black toner and each color toner, is preferably 10 to 60% by mass, and more preferably 15 to 50% by mass relative to the total amount of the monomers forming the crystalline polyester resin, although it is not particularly limited thereto. Namely, relative to the total amount of the constitutional units of the crystalline polyester resin, the amount of the constitutional unit derived from the linear chain aliphatic diol is preferably 10 to 60% by mass, and more preferably 15 to 50% by mass. When it is within this range, behavior of the crystalline polyester resin can be easily controlled so that it becomes easier to control the charging property.

With regard to the relationship between the black toner and each color toner, it is preferable that $C_{Ye}$, $C_{Ma}$, $C_{Cy}$, and $C_{Bk}$ satisfy the following formulas (1) to (3). When those formulas are satisfied, the low temperature fixability, reduction of image noise, and reduction of the environment dependent property of image density can be achieved with good balance. Furthermore, from the same point of view, it is more preferable that $C_{Ye}$, $C_{Ma}$, $C_{Cy}$, and $C_{Bk}$ satisfy the following formulas (4) to (6).

$$1 \leq C_{Bk} - C_{Ye} \leq 6 \quad (1)$$

$$1 \leq C_{Bk} - C_{Ma} \leq 6 \quad (2)$$

$$1 \leq C_{Bk} - C_{Cy} \leq 6 \quad (3)$$

$$2 \leq C_{Bk} - C_{Ye} \leq 4 \quad (4)$$

$$2 \leq C_{Bk} - C_{Ma} \leq 4 \quad (5)$$

$$2 \leq C_{Bk} - C_{Cy} \leq 4 \quad (6)$$

(Polycarboxylic Acid)

The polycarboxylic acid used for preparation of the crystalline polyester resin, which is contained in the black toner and each color toner, is not particularly limited. Examples thereof include saturated aliphatic dicarboxylic acid such as oxalic acid, malonic acid, succinic acid, adipic acid, pimelic acid, sebacic acid, azelaic acid, n-dodecylsuccinic acid, 1,9-nonane dicarboxylic acid, 1,10-decane dicarboxylic acid, 1,11-undecane dicarboxylic acid, 1,12-dodecane dicarboxylic acid (tetradecane diacid), 1,13-tridecane dicarboxylic acid, or 1,14-tetradecane dicarboxylic acid; and alicyclic dicarboxylic acid such as cyclohexane dicarboxylic acid. It is also possible to use polycarboxylic acid other than the dicarboxylic acid. It is also possible to use lower alkylester or acid anhydride thereof. The polycarboxylic acid may be used either singly or as a mixture of two or more kinds thereof.

Among them, from the viewpoint of having easy control of the charging property of a toner particle by controlling the behaviors of the crystalline polyester resin in the black toner and each color toner, it is preferable to use a linear chain aliphatic dicarboxylic acid as polycarboxylic acid. From the same point of view, it is preferable to use, as polycarboxylic acid, a linear chain aliphatic dicarboxylic acid having a carbon number of 6 or more and 20 or less. It is particularly preferable to use a linear chain aliphatic dicarboxylic acid having a carbon number of 10 or more and 15 or less.

The method for synthesizing the crystalline polyester resin using the above monomers is not particularly limited, the resin can be synthesized by polycondensation (esterification) between the linear chain aliphatic diol and polycarboxylic using a known catalyst for esterification.

Examples of the catalyst which may be used for the preparation include an alkaline metal compound such as sodium and lithium; a compound containing an element of Group 2 such as magnesium and calcium; a metal compound such as aluminum, zinc, manganese, antimony, titanium, tin, zirconium, and germanium; a phosphorus acid compound; a phosphoric acid compound; and an amine compound. Considering the easy availability or the like, dibutyl tin oxide, tin octylate, tin dioctylate, or a salt thereof, tetra normal butyl titanate (tetrabutyl orthotitanate), tetraisopropyl titanate (titanium tetraisopropoxide), tetramethyl titanate or the like are preferably used. The catalyst may be used either singly or as a mixture of two or more kinds thereof.

The temperature for polycondensation (esterification) is not particularly limited, but it is preferably 150 to 250° C. Furthermore, the time for polycondensation (esterification) is not particularly limited, but it is preferably 0.5 to 15 hours. During the polycondensation, the pressure inside the reaction system may be lowered, if necessary.

The number average molecular weight (Mn) of the crystalline polyester resin is preferably within a range of 1,500 to 25,000, and more preferably within a range of 3,000 to 20,000 although it is not particularly limited. When it is within this range, the low temperature fixability can be further enhanced. The number average molecular weight (Mn) can be measured by gel permeation chromatography (GPC), and specifically, it can be measured by the method described in Examples.

In the present invention, the black toner and color toner contains, in addition to the crystalline polyester resin, an amorphous resin as a binder resin. The amount of the crystalline polyester resin in the black toner and each color toner is, relative to the total amount of the binder resin, preferably 1 to 30% by mass, more preferably 3 to 20% by mass, and particularly preferably 6 to 17% by mass. When the amount of the crystalline polyester resin is 1% by mass or more, plasticization at suitable level can be obtained based on compatibility with an amorphous resin, thus yielding easy enhancement of the low temperature fixability. On the other hand, when the amount of the crystalline polyester resin is 30% or less, the plasticization is suppressed at suitable level so that image noise is further suppressed even in a high temperature and high humidity environment.

Similarly, also from the viewpoint of enhancing the low temperature fixability and suppressing the image noise, the amount of the crystalline polyester resin in the black toner and each color toner is preferably 1 to 30% by mass, more preferably 3 to 20% by mass, and particularly preferably 6 to 15% by mass relative to the total mass of the crystalline polyester resin, amorphous resin, and releasing agent.

Furthermore, the structure of each constitutional component (each constitutional unit) and an amount (content ratio) of each constitutional component (each constitutional unit) of the crystalline polyester resin can be characterized by NMR measurement, methylation Py-GC/MS measurement, or the like, for example.

<<Amorphous Resin>>

The toner particle contains an amorphous resin as a binder resin. The amorphous resin is preferably a main component of the binder resin contained in each toner. As the binder resin contains an amorphous resin as a main component, it becomes easier for the amorphous resin to be present on a surface of a toner particle. As a result, due to high electric resistance of an amorphous resin, a favorable charging property of a toner particle can be obtained. As described herein, the expression "main component" means a resin which has the highest content ratio in the binder resin. The amorphous resin is preferably 50% by mass or more, more preferably 70 to 99% by mass, even more preferably 80 to 97% by mass, and particularly preferably 83 to 94% by mass relative to the total amount of the binder resin.

Herein, the amorphous resin indicates a resin which has no melting point but relatively high glass transition temperature (Tg) when differential scanning calorimetry (DSC) measurement is carried out therefor. In this regard, the glass transition temperature (Tg) is preferably 30 to 80° C., and particularly preferably 40 to 65° C. Furthermore, the glass transition temperature (Tg) can be measured by differential scanning calorimetry (DSC), and specifically, it is measured by the method described in Examples. Furthermore, the glass transition temperature can be controlled by a person skilled in the pertinent art on the basis of the resin composition.

As for the amorphous resin, an amorphous resin conventionally known in the pertinent art can be used. However, an amorphous polyester resin or a vinyl resin is preferable, in particular. It is also possible to use them as a mixture.

(Amorphous Polyester Resin)

The amorphous polyester resin indicates a polyester resin which has no melting point but relatively high glass transition temperature (Tg) when differential scanning calorimetry (DSC) measurement is carried out therefor. Furthermore, because a preferred range of the glass transition temperature (Tg) is the same as above, explanations therefor are omitted herein. Additionally, the monomer forming the amorphous polyester resin is different from the monomer forming the crystalline polyester resin, and thus differentiation from the crystalline polyester resin can be made by an analysis such as NMR. Due to a difference in the type or structure (crystalline or amorphous) of the monomer, it can be said that the amorphous polyester resin has higher electric resistance compared to the crystalline polyester resin.

The amorphous polyester resin is obtained by a polycondensation reaction between di- or higher carboxylic acid (polycarboxylic acid) and di- or higher hydric alcohol (polyhydric alcohol). The amorphous polyester resin is not particularly limited, an amorphous polyester resin which is conventionally known in the pertinent art can be used.

Examples of the polycarboxylic acid and polyhydric alcohol which are used for preparation of the amorphous polyester resin include the followings, although they are not particularly limited.

(Polycarboxylic Acid)

As for the polycarboxylic acid, unsaturated aliphatic polycarboxylic acid, aromatic polycarboxylic acid, and a derivative thereof can be preferably used. As long as an amorphous polyester resin can be formed, it is also possible to use saturated aliphatic polycarboxylic acid in combination.

Examples of the unsaturated aliphatic polycarboxylic acid include unsaturated aliphatic dicarboxylic acid such as methylene succinic acid, fumaric acid, maleic acid, 3-hexenedioic acid, 3-octenedioic acid, or succinic acid substituted with an alkenyl group having 2 to 20 carbon atoms; unsaturated aliphatic tricarboxylic acid such as 3-butene-1,2,3-tricaboxylic acid, 4-pentene-1,2,4-tricarboxylic acid, or aconitic acid; and unsaturated aliphatic tetracarboxylic acid such as 4-pentene-1,2,3,4-tetracarboxylic acid. It is also possible to use lower alkyl ester or acid anhydride thereof.

Examples of the aromatic polycarboxylic acid include aromatic dicarboxylic acid such as phthalic acid, terephthalic acid, isophthalic acid, t-butylisophthalic acid, tetrachlorophthalic acid, chlorophthalic acid, nitrophthalic acid, p-phenylene diacetic acid, 2,6-naphthalene dicarboxylic acid, 4,4'-biphenyldicarboxylic acid, or anthracene dicarboxylic acid; aromatic tricarboxylic acid such as 1,2,4-benzene tricarboxylic acid (trimellitic acid), 1,2,5-benzene tricarboxylic acid (trimesic acid), 1,2,4-naphthalene tricarboxylic acid, or hemimellitic acid; aromatic tetracarboxylic acid such as pyromellitic acid; and aromatic hexacarboxylic acid such as mellitic acid. It is also possible to use lower alkylester or acid anhydride thereof. The polycarboxylic acid may be used either singly or as a mixture of two or more kinds thereof.

(Polyhydric Alcohol)

From the viewpoint of the charging property, as a polyhydric alcohol, it is preferable to use unsaturated aliphatic polyhydric alcohol, aromatic polyhydric alcohol, or a derivative thereof. As long as an amorphous resin can be obtained, it is also possible to use saturated aliphatic polyhydric alcohol in combination.

Examples of the unsaturated aliphatic polyhydric alcohol include unsaturated aliphatic diol such as 2-butene-1,4-diol, 3-butene-1,4-diol, 2-butyne-1,4-diol, 3-butyne-1,4-diol, or 9-octadecene-7,12-diol, and a derivative thereof can be also used.

Examples of the aromatic polyhydric alcohol include bisphenols such as bisphenol A or bisphenol F, and an alkylene oxide adduct of bisphenols such as ethylene oxide adduct or propylene oxide adduct of those bisphenols, 1,3,5-benzenetriol, 1,2,4-benzenetriol, and 1,3,5-trihydroxymethylbenzene, and it is also possible to use a derivative thereof. Among them, from the viewpoint of having easy optimization of thermal characteristics, in particular, a bisphenol A compound like ethylene oxide adduct or propylene oxide adduct of bisphenol A is preferably used.

Furthermore, although the carbon number of tri- or higher hydric alcohol is not particularly limited, from the viewpoint of having easy optimization of thermal characteristics, in particular, the carbon number is preferably 3 to 20.

The polyhydric alcohol may be used either singly or as a mixture of two or more kinds thereof.

The method for synthesizing the amorphous polyester resin is not particularly limited, the resin can be synthesized by polycondensation (esterification) between the polycarboxylic acid and polyhydric alcohol using a known catalyst for esterification.

The catalyst usable for the preparation, temperature and time for the polycondensation (esterification) are not particularly limited. Because they are the same as described in the above section of <<Crystalline polyester resin>>, detailed explanations thereof are omitted herein.

The weight average molecular weight (Mw) of the amorphous polyester resin is preferably within a range of 5,000 to 100,000, and more preferably within a range of 5,000 to 50,000 although it is not particularly limited. When the weight average molecular weight (Mw) is 5,000 or more, the heat resistant storage property of a toner can be enhanced. On the other hand, when it is 100,000 or less, the low temperature fixability can be further enhanced. The weight average molecular weight (Mw) can be measured by gel permeation chromatography (GPC), and specifically, it can be measured by the method described in Examples.

(Vinyl Resin)

The vinyl resin indicates a resin which is obtained by polymerization using at least a vinyl monomer. Specific examples of the vinyl resin include an acrylic acid and a styrene acrylic copolymer resin (styrene acrylic resin).

Among them, the vinyl resin is preferably a styrene acrylic copolymer resin which is formed by using a styrene monomer and a (meth)acrylic acid ester monomer. Furthermore, the vinyl resin may be used either singly or in combination of two or more kinds thereof.

As for the vinyl monomer for forming the vinyl resin, one or more kinds that are selected from the followings can be used.

(1) Styrene Monomer

Styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene, and a derivative thereof.

(2) (Meth)acrylic Acid Ester Monomer

Methyl (meth)acrylate, ethyl (meth)acrylate, n-butyl (meth)acrylate, isopropyl (meth)acrylate, isobutyl (meth) acrylate, t-butyl (meth)acrylate, n-octyl (meth)acrylate, 2-ethylhexyl (meth)acrylate, stearyl (meth)acrylate, lauryl (meth)acrylate, phenyl (meth)acrylate, diethylaminoethyl (meth)acrylate, dimethylaminoethyl acrylate, and a derivative thereof.

(3) Vinyl Esters

Vinyl propionate, vinyl acetate, vinyl benzoate, and the like.

(4) Vinyl Ethers

Vinyl methyl ether, vinyl ethyl ether, and the like.

(5) Vinyl Ketones

Vinyl methyl ketone, vinyl ethyl ketone, vinyl hexyl ketone, and the like.

(6) N-Vinyl Compounds

N-Vinylcarbazole, N-vinylindole, N-vinylpyrrolidone, and the like.

(7) Others

Vinyl compounds such as vinyl naphthalene or vinyl pyridine, derivative of acrylic acid or methacrylic acid such as acrylonitrile, methacrylonitrile, or acrylamide, and the like.

Furthermore, as for the vinyl monomer, it is preferable to use a monomer having an ionic dissociating group such as carboxyl group, sulfonic acid group, or phosphoric acid group. Specific examples thereof are described below.

Examples of the monomer having carboxylic acid group include acrylic acid, methacrylic acid, maleic acid, itaconic acid, cinnamic acid, fumaric acid, maleic acid monoalkyl ester, and itaconic acid monoalkyl ester. Furthermore, examples of the monomer having sulfonic acid group include styrene sulfonic acid, allylsulfonic succinic acid, and 2-acrylamide-2-methylpropane sulfonic acid. Furthermore, examples of the monomer having phosphoric acid group include acid phosphoxyethyl methacrylate.

It is also possible to use a vinyl resin with cross-linked structure prepared by using polyfunctional vinyls as a vinyl monomer. Examples of the polyfunctional vinyls include divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, and neopentyl glycol diacrylate.

Method for producing a vinyl resin is not particularly limited, and a method for carrying out the polymerization by known polymerization method like bulk polymerization, solution polymerization, emulsion polymerization, mini-emulsion method, and dispersion polymerization with using any polymerization initiator such as peroxides, persulfates, persulfides, or azo compounds which are commonly used for the polymerization of above monomers can be mentioned. Furthermore, for the purpose of controlling the molecular weight, a commonly used chain transfer agent can be used. The chain transfer agent is not particularly limited, and examples thereof include alkyl mercaptan and mercapto fatty acid ester.

Furthermore, the weight average molecular weight (Mw) of the vinyl resin which is measured by gel permeation chromatography (GPC) is preferably 10,000 to 100,000.

In the present invention, the amorphous resin contained in the black toner and each color toner preferably contains a vinyl resin, and more preferably contains a styrene acrylic resin. Compared to the amorphous polyester resin, the vinyl resin (in particular, styrene acrylic resin) has fewer functional groups having high polarity and lower moisture absorption property. As such, a favorable transfer property can be obtained in high temperature and high humidity environment. Accordingly, the environment dependent property of image density can be easily lowered. The amount of the styrene acrylic resin in an amorphous resin is not particularly limited. As described above, from the viewpoint of lowering the environment dependent property of image density, the amount of the styrene acrylic resin is preferably 50% by mass or more, more preferably 80% by mass or more, particularly preferably 90% by mass or more, and most preferably 100% by mass relative to the total amount of the amorphous resin.

<<Colorant>>

The black toner and each color toner contain a colorant corresponding to each color in addition to the binder resin (a crystalline polyester resin and an amorphous resin) and releasing agent.

The amount of each colorant is preferably 1 to 30 parts by mass, and more preferably 3 to 20 parts by mass relative to 100 parts by mass of toner particle. When the amount is within this range, the color reproducibility of an image can be surely obtained.

Hereinbelow, explanations are given for the type of a colorant for each color.

(Black Colorant)

The colorant that can be used for the black toner is not particularly limited, and include carbon black, magnetic material, dyes, and pigments. Channel black, furnace black, acetylene black, thermal black, lamp black or the like can be used as carbon black. A ferromagnetic metal such as iron, nickel, or cobalt, an alloy containing those metals, a compound of ferromagnetic metal such as ferrite, or magnetite, or the like can be used as a magnetic material. Furthermore, Black titanium oxide, aniline black or the like can be used as a pigment.

Among them, carbon black has a relatively low resistance value. However, according to the present invention, a favorable charging property in high temperature and high humidity environment can be obtained, even when carbon black is used as a colorant. Thus, the environment dependent property of image density can be lowered.

(Yellow Colorant)

The colorant for orange or yellow which is used for a yellow toner is not particularly limited. Examples thereof include, as an organic pigment, C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 74, C.I. Pigment Yellow 93, C.I. Pigment Yellow 94, C.I. Pigment Yellow 138, C.I. Pigment Yellow 155, C.I. Pigment Yellow 180, and C.I. Pigment Yellow 185. Furthermore, examples of the dye include C.I. Solvent Yellow 19, C.I. Solvent Yellow 44, C.I. Solvent Yellow 77, C.I. Solvent Yellow 79, C.I. Solvent Yellow 81, C.I. Solvent Yellow 82, C.I. Solvent Yellow 93, C.I. Solvent Yellow 98, C.I. Solvent Yellow 103, C.I. Solvent Yellow 104, C.I. Solvent Yellow 112, and C.I. Solvent Yellow 162. Those colorants may be used either singly or two or more kinds thereof may be used in combination.

(Magenta Colorant)

The colorant for magenta or red which is used for a magenta toner is not particularly limited. Examples thereof include, as an organic pigment, C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48;1, C.I. Pigment Red 53;1, C.I. Pigment Red 57;1, Pigment Red 81;4, C.I. Pigment Red 122, C.I. Pigment Red 123, C.I. Pigment Red 139, C.I. Pigment Red 144, C.I. Pigment Red 149, C.I. Pigment Red 150, C.I. Pigment Red 166, C.I. Pigment Red 177, C.I. Pigment Red 178, Pigment Red 184, C.I. Pigment Red 222, C.I. Pigment Red 238, and C.I. Pigment Red 269. Furthermore, examples of the dye include C.I. Solvent Red 1, Solvent Red 11, C.I. Solvent Red 49, C.I. Solvent Red 52, C.I. Solvent Red 58, C.I. Solvent Red 68, C.I. Solvent Red 111, C.I. and Solvent Red 122. Those colorants may be used either singly or two or more kinds thereof may be used in combination.

(Cyan Colorant)

The colorant for green or cyan which is used for a cyan toner is not particularly limited. Examples thereof include, as an organic pigment, C.I. Pigment Blue 15, C.I. Pigment Blue 15:2, C.I. Pigment Blue 15:3, C.I. Pigment Blue 15:4, C.I. Pigment Blue 16, C.I. Pigment Blue 60, C.I. Pigment Blue 62, C.I. Pigment Blue 66, C.I. Pigment Blue 76, C.I. and Pigment Green 7. Furthermore, examples of the dye include C.I. Solvent Blue 25, C.I. Solvent Blue 36, C.I. Solvent Blue 69, C.I. Solvent Blue 70, C.I. Solvent Blue 93, and C.I. Solvent Blue 95. Those colorants may be used either singly or two or more kinds thereof may be used in combination.

Each of the above colorants (in particular, organic pigment) used for the yellow toner, magenta toner, and cyan toner has relatively high electric resistance. Therefore, the charging amount on a surface of a toner particle is high in low temperature and low humidity environment, and as a result, a decrease in transfer property is caused. However, according to the present invention, even when colorants having high electric resistance are used, the charging amount can be kept at low level in low temperature and low humidity environment, in particular. Thus, the environment dependent property of image density can be lowered.

(Size of Colorant Particle)

Furthermore, size of the colorant (particle) is not particularly limited, but the volume-based median diameter is preferably 10 to 1000 nm, more preferably 50 to 500 nm, and particularly preferably 80 to 300 nm. The volume-based median diameter within this range is preferable in that not only the high color reproducibility can be obtained but also it is suitable for forming a toner with small diameter required for having high image quality. Furthermore, the volume-based median diameter of the colorant (particle) can be measured by "UPA-150" (manufactured by Nikkiso Co., Ltd.), which is MICROTRAC (registered trademark, ditto in the followings) particle size distribution analyzer, for example.

<<Releasing Agent>>

Each of the toner particles of the black toner and color toner which are used in the present invention contains a releasing agent (wax).

Examples of the releasing agent include hydrocarbon-based wax such as low molecular weight polyethylene wax, low molecular weight polypropylene wax, Fischer Tropsch wax, microcrystalline wax, or paraffin wax, and ester wax such as carnauba wax, pentaerythritol behenic acid ester, behenyl behenate, or behenyl citrate. They can be used either singly or in combination of two or more kinds thereof.

An amount of the releasing agent is preferably 2 to 20% by mass, more preferably 3 to 18% by mass, and particularly preferably 5 to 15% by mass relative to the total mass of the binder resin.

Furthermore, the melting point of the releasing agent is, from the viewpoint of the low temperature fixability and release property of a toner in electrophotographic method, preferably 50 to 95° C.

<<Charge Control Agent>>

The toner particle of the black toner and color toner which are used in the present invention may contain other internal additives, if necessary. Examples of the internal additives include a charge control agent. Examples of the charge control agent include zinc or aluminum metal complex with salicylic acid derivative (salicylic acid metal complex), calixarene compound, organic boron compound, and quaternary fluoroammonium salt compound.

An amount of the charge control agent is preferably 0.1 to 10 parts by mass, and more preferably 0.5 to 5 parts by mass relative to 100 parts by mass of the binder resin in toner.

<<Structure of Toner Particle>>

The toner particle may have a so-called monolayer structure or a core-shell structure (a structure in which resin forming a shell layer is aggregated and fused on a surface of a core particle). The toner particle with core-shell structure preferably has a structure in which a resin area (shell layer) having relatively high glass transition temperature is provided on a surface of a resin particle (core particle) having relatively low glass transition temperature which contains a colorant or a releasing agent. Furthermore, the core-shell structure is not limited to the structure in which the core particle is completely coated with a shell layer, and it includes a structure in which the core particle is not completely coated with a shell layer so that the core particle is exposed partially.

Furthermore, from the viewpoint of enhancing the charging property in high temperature and high humidity environment, the black toner according to the present invention preferably has a structure in which the crystalline polyester resin is contained in the inside of a toner particle without being exposed on a surface of the toner particle and, at the same time, the amorphous resin is exposed on a surface of a toner particle. Meanwhile, from the viewpoint of enhancing the transfer property in a low temperature and low humidity environment and lowering the image noise in high temperature and high humidity environment and/or under low printing ratio condition, in particular, the color toner of the present invention has a structure in which the crystalline polyester resin is exposed on a surface of the toner particle. The each structure of the toner particle of the black toner and color toner can be controlled, as described in the above, by a carbon number of a linear chain aliphatic diol which forms the crystalline polyester resin. Furthermore, as described in the followings, the structure of the toner particle can be also controlled based on timing for adding each resin when toner particles are produced by an emulsion aggregation method.

Furthermore, from the viewpoint of having easy control of the charging property based on the composition of a binder resin, the black toner and color toner according to the present invention preferably contain a binder resin preferably in an amount of 60 to 95% by mass, more preferably 70 to 90% by mass, and particularly preferably 80 to 85% by mass relative to the total mass of the toner particles (total mass including the binder resin, releasing agent, and colorant). Furthermore, from the same point of view, the amount of the binder resin (amount of the binder resin relative to the total mass of the toner particles) in a black toner is preferably the same as the amount of the binder resin (amount of the binder resin relative to the total mass of the toner particles) in a color toner.

The aforementioned structure of the toner particle (cross-section structure of core-shell structure or location of the crystalline polyester resin) can be confirmed by using a known means like transmission electron microscope (TEM) or scanning probe microscope (SPM).

<<Average Circularity of Toner Particle>>

From the viewpoint of enhancing the low temperature fixability, the average circularity of the toner particle is preferably 0.920 to 1.000, and more preferably 0.940 to 0.995. Herein, the average circularity indicates a value which is measured by using "FPIA-2100" (manufactured by Sysmex Corporation). Specifically, the toner particles are moisturized with an aqueous solution of surfactant and subjected to ultrasonic dispersion for 1 minute, and after dispersion, the measurement is carried out by using "FPIA-2100" at an appropriate concentration to have the HPF detection number of 4000 under the measurement condition of HPF (high pass filter imaging) mode. The circularity is calculated based on the following formula.

Circularity=(Circumferential length of circle having an equivalent to a projection area of a particle image)/(Circumferential length of projected image of a particle)

Furthermore, the average circularity indicates as an arithmetic mean value which is obtained by dividing the sum of the circularity of each particle by total number of measured particles.

<<Particle Diameter of a Toner Particle>>

With regard to the particle diameter of a toner particle, the volume-based median diameter (D50) is preferably 3 to 10 μm. As the volume-based median diameter is within this range, fine line reproducibility and high image quality of a photographic image can be achieved, and at the same time, the toner consumption amount can be reduced compared to a case in which a toner with large particle size is used. It is also possible to have toner fluidity. Herein, the volume-based median diameter (D50) of a toner particle can be measured and calculated by using "COULTER COUNTER MULTISIZER 3" (registered trademark, manufactured by Beckman Coulter, Inc.) which is connected with a computer system for data processing.

Furthermore, the volume-based median diameter of a toner particle can be controlled by concentration of an aggregating agent, addition amount of a solvent, fusion time during the aggregation-fusion process for producing the toner that is described below, and also the composition of resin components.

<<External Additives>>

From the viewpoint of enhancing the charging performance, fluidity, or cleaning property, the black toner and color toner of the present invention preferably contain, as external additives, particles like inorganic particles and organic particles, a lubricating agent, or the like on a surface of a toner particle. As for the external additives, various additives may be used in combination. Examples of the particles include inorganic oxide particles such as silica particles, alumina particles, titania particles, inorganic stearate compound particles such as aluminum stearate particles or zinc stearate particles, and inorganic titanate compound particles such as strontium titanate particles or zinc titanate particles. Furthermore, examples of the lubricating agent include metal salt of higher fatty acid such as zinc, aluminum, copper, magnesium, or calcium salt of stearic acid, zinc, manganese, iron, copper, or magnesium salt of oleic acid, zinc, copper, magnesium, or calcium salt of palmitic acid, zinc or calcium salt of linoleic acid, or zinc or calcium salt of ricinoleic acid. The external additives may be subjected to a surface treatment using a silane coupling agent or a titanium coupling agent, or using higher fatty acid or silicone oil, from the viewpoint of the heat resistant storage property and environment stability. The external additives may be used either singly or as a mixture of two or more kinds thereof.

Among the above, inorganic oxide particles such as silica particles (spherical silica), alumina particles, or titania particles are preferably used as an external additive.

The addition amount of the external additives (when two or more kinds are used, total amount) is preferably 0.05 to 5% by mass, and more preferably 0.1 to 3% by mass relative to 100% by mass of the total mass of the toner including external additives.

Particle diameter of the external additive is not particularly limited. However, inorganic fine particles with number average primary particle diameter of 2 to 800 nm or so or organic fine particles with number average primary particle diameter of 10 to 2000 nm or so are preferable. Furthermore, in the present specification, the expression "number average primary particle diameter" indicates an average value which is obtained by binarization of a scanning electron micrograph image of a particle of external additives and calculating the horizontal Feret diameter for 10,000 pieces.

[Method for Producing Toner]

Hereinbelow, explanations are given for the method for producing the black toner and color toner (toner for electrostatic latent image) which are used for the present invention.

A method for producing the toner used in the present invention is not particularly limited, and examples thereof include a conventionally known method such as a kneading and pulverizing method, a suspension method, an emulsion aggregation method, a dissolution suspension method, a polyester elongation method, and a dispersion polymerization method.

Among them, from the viewpoint of the uniformity of particle diameter, shape controllability, and easiness for forming the core-shell structure, it is preferable to employ an emulsion aggregation method. Hereinbelow, the emulsion aggregation method is explained.

<<Emulsion Aggregation Method>>

An emulsion aggregation method is a method for producing toner particles in which a dispersion of particles of a binder resin (hereinbelow, also referred to as "binder resin particles"), which are dispersed with an aid of a surfactant or a dispersion stabilizer, is mixed with a dispersion of particles of a releasing agent (hereinbelow, also referred to as "releasing agent particles"), the particles are aggregated till to have a desired particle diameter, and fusion between binder resin particles is additionally carried out to have shape control. Herein, the binder resin particles may contain, if necessary, a colorant, a charge control agent, or the like.

When a toner for developing an electrostatic latent image is produced by an emulsion aggregation method, the production method according to a preferred embodiment includes the following:

(a) preparing dispersion of crystalline polyester resin particles, dispersion of amorphous resin particles, dispersion of colorant particles, and dispersion of releasing agent particles (hereinbelow, also referred to as a "preparation step"), and (b) mixing the dispersion of crystalline polyester resin particles, dispersion of amorphous resin particles, dispersion of colorant particles, and dispersion of releasing agent particles to have aggregation-fusion (hereinbelow, also referred to as an "aggregation-fusion step").

Hereinbelow, the steps (a) and (b), and steps (c) to (g) that are arbitrarily carried out other than the steps (a) and (b) are described in detail.

(a) Preparation Step

The step (a) includes a step for preparing dispersion of crystalline polyester resin particles, a step for preparing dispersion of amorphous resin particles, a step for preparing dispersion of colorant particles, and a step for preparing dispersion of releasing agent particles.

(a-1) Step for Preparing Dispersion of Crystalline Polyester Resin Particles

The step for preparing dispersion of crystalline polyester resin particles is a step in which the crystalline polyester resin constituting the binder resin is synthesized and dispersion of crystalline polyester resin particles is prepared by dispersing the crystalline polyester resin in fine particle form in an aqueous medium.

Because the method for preparing the crystalline polyester resin is the same as described above, explanations thereof are omitted herein.

As the method for preparing the dispersion of crystalline polyester resin particles, a method of performing a dispersion treatment in an aqueous medium without using any solvent, and a method in which a crystalline polyester resin is dissolved in a solvent like ethyl acetate or methyl ethyl ketone to give a solution, the solution is subjected to emulsifying dispersion in an aqueous medium using a disperser, and a solvent-removing treatment is carried out can be mentioned.

In the present invention, the "aqueous medium" means a medium which contains water at least in an amount of 50% by mass or more. Examples of a component other than water include an organic solvent which can be dissolved in water, and examples thereof include methanol, ethanol, isopropanol, acetone, dimethyl formamide, methyl cellosolve, and tetrahydrofuran. Among them, it is preferable to use an alcohol-based organic solvent, which is an organic solvent not dissolving the resin, for example, methanol, ethanol, and isopropanol. Preferably, only water is used as an aqueous medium.

When a carboxyl group is contained in the structure of a crystalline polyester resin, ammonia, sodium hydroxide or the like may be added to have smooth progress of emulsification by ion dissociation of the carboxy group and stable emulsification in aqueous phase. Furthermore, a dispersion stabilizer may be dissolved in an aqueous medium and a surfactant, resin particles, or the like may be added to the aqueous medium for the purpose of enhancing the dispersion stability of oil droplets.

As for the dispersion stabilizer, a publicly known dispersion stabilizer can be used, and it is preferable to use a dispersion stabilizer which is soluble in acid or alkali such as tricalcium phosphate, for example. Alternatively, from the viewpoint of an environment, it is preferable to use a dispersion stabilizer which can be decomposed by an enzyme. Examples of the surfactant which can be used include a publicly known anionic surfactant, cationic surfactant, non-ionic surfactant, and amphoteric surfactant. Furthermore, examples of the resin particles for enhancing the dispersion stability include particles of methyl polymethacrylate resin, particles of polystyrene resin, and particles of polystyrene-acrylonitrile resin.

The dispersion treatment can be carried out by using mechanical energy. The disperser is not particularly limited, and examples thereof include a homogenizer, a low speed shear type disperser, a high speed shear type disperser, a friction type disperser, a high pressure jet type disperser, an ultrasonic disperser, a high pressure impact type disperser altimizer, and an emulsifying disperser.

It is preferable to heat the solution during dispersion. The heating conditions are not particularly limited, but they are generally 60 to 200° C. or so.

The volume-based median diameter of the crystalline polyester resin particles in dispersion of crystalline polyester resin particles which is prepared as described above is preferably 60 to 1000 nm, and more preferably 80 to 500 nm. Furthermore, the median diameter can be controlled based on the amount of mechanical energy for emulsifying dispersion or the like.

The amount of crystalline polyester resin particles in dispersion of crystalline polyester resin particles is preferably in the range of 10 to 50% by mass, and more preferably in the range of 15 to 40% by mass relative to the total dispersion. As the amount is within this range, spreading of the particle size distribution is suppressed so that the toner characteristics can be improved.

(a-2) Step for Preparing Dispersion of Amorphous Resin Particles

In the step for preparing dispersion of amorphous resin particles, aqueous dispersion of amorphous polyester resin and/or aqueous dispersion of vinyl resin is/are prepared. Herein, as for the method for preparing aqueous dispersion of amorphous polyester resin, a method which is the same as the above (a-1) is used, and thus detailed explanations are omitted herein. In the followings, a method for preparing dispersion of vinyl resin particles (preparation step) is explained.

In the step for preparing dispersion of vinyl resin particles, aqueous dispersion of vinyl resin is prepared. When a vinyl resin is obtained by performing emulsifying polymerization in an aqueous medium, for example, liquid after the polymerization reaction can be directly used as dispersion of vinyl resin particles.

Alternatively, it is also possible to use a method in which an isolated vinyl resin is pulverized if necessary, and in the presence of a surfactant, the vinyl resin is dispersed in an aqueous medium by using an ultrasonic disperser or the like. Because the specific examples of the aqueous medium and surfactant are the same as those of the above (a-1), explanations thereof are omitted herein.

The volume-based median diameter of the vinyl resin particles in dispersion of vinyl resin particles is preferably within a range of 60 to 1000 nm, and more preferably 80 to 500 nm. Furthermore, the median diameter can be controlled based on the amount of mechanical energy during polymerization or the like.

The amount of vinyl resin particles in dispersion of vinyl resin particles is preferably in the range of 10 to 50% by mass, and more preferably in the range of 15 to 40% by mass relative to the total amount of the dispersion. As the amount is within this range, broadening of the particle size distribution is suppressed so that the toner characteristics can be improved.

(a-3) Step for Preparing Dispersion of Colorant Particles

The step for preparing dispersion of colorant particles is a step in which a colorant is dispersed in fine particle form in an aqueous medium to prepare dispersion of colorant particles.

Because the aqueous medium is the same as those of the above (a-1), explanations thereof are omitted herein. A surfactant, resin particles, or the like may be added to the aqueous medium for the purpose of enhancing the dispersion stability.

Dispersion of a colorant can be performed with a disperser using mechanical energy. The disperser is not particularly limited and the disperser described in the above (a-1) can be used.

The volume-based median diameter of the colorant particles in dispersion of colorant particles is preferably within a range of 10 to 300 nm.

The amount of the colorant in dispersion of colorant particles is preferably in the range of 5 to 45% by mass, and more preferably in the range of 10 to 30% by mass relative to the total dispersion. As the amount is within this range, the effect of having the color reproducibility can be obtained.

(a-4) Step for Preparing Dispersion of Releasing Agent Particles

The step for preparing dispersion of releasing agent particles is a step in which a releasing agent is dispersed in fine particle form in an aqueous medium to prepare dispersion of releasing agent particles.

The aqueous medium is the same as those of the above (a-1), and a surfactant, resin particles, or the like may be added to the aqueous medium for the purpose of enhancing the dispersion stability.

Dispersion of a releasing agent can be performed with a disperser using mechanical energy. The disperser is not particularly limited and the disperser described in the above (a-1) can be used.

The volume-based median diameter of the releasing agent particles in dispersion of releasing agent particles is preferably within a range of 10 to 300 nm.

The amount of the releasing agent in dispersion of releasing agent particles is preferably in the range of 5 to 45% by mass, and more preferably in the range of 8 to 30% by mass relative to the total dispersion. As the amount is within this range, the effect of preventing hot offset and having the separation property can be obtained.

(b) Aggregation-Fusion Step

The aggregation-fusion step is a step in which the aforementioned crystalline polyester resin particles, amorphous resin particles, colorant particles, and releasing agent particles are aggregated in an aqueous medium, and simultaneously with the aggregation, those particles are subjected to fusion.

According to this step, dispersion of crystalline polyester resin particles, dispersion of amorphous resin particles, dispersion of colorant particles, and dispersion of releasing agent particles are first mixed with one another, and those particles are dispersed in an aqueous medium.

Next, after adding an aggregation agent, aggregation is allowed to proceed by heating at the temperature which is higher than the glass transition temperature of an amorphous resin, and simultaneously, the resin particles are aggregated with one another.

The aggregation agent is not particularly limited, but those selected from metal salts such as alkali metal salts or salts of Group 2 metal are suitably used. Examples of the metal salt include a monovalent metal salt like sodium, potassium and lithium; a divalent metal salt like calcium, magnesium, manganese, and copper; and trivalent metal salt like iron and aluminum. Specific examples of the metal salt include sodium chloride, potassium chloride, lithium chloride, calcium chloride, magnesium chloride, zinc chloride, copper sulfate, magnesium sulfate, manganese sulfate, and aluminum sulfate. Among them, from the viewpoint of having a progress of aggregation with a smaller amount, it is particularly preferable to use a divalent or trivalent metal salt. The aggregation agent may be used either singly or in combination of two or more types thereof.

The use amount of the aggregation agent is, although not particularly limited, preferably 0.1 to 15 parts by mass, and more preferably 1 to 10 parts by mass relative to 100 parts by mass of the solid content of the binder resin which constitutes the toner particles.

With regard to the aggregation step, it is preferable that temperature is rapidly increased by heating after adding an aggregation agent, and the temperature increase rate is preferably 0.05° C./minute or higher. The upper limit of the temperature increase rate is, although not particularly limited, preferably 15° C./minute or lower from the viewpoint of suppressing an occurrence of coarse particles which is caused by a progress of rapid fusion. Furthermore, it is important that, after the dispersion for aggregation reaches a desired temperature, temperature of the dispersion for aggregation is maintained for a certain period of time, preferably until that the volume-based median diameter becomes 4.5 to 7.0 μm, to continue the fusion.

(c) Aging Step

This step is performed as required, and according to the aging step, an aging treatment by which associated particles obtained by the aggregation-fusion step are aged by heat energy till to have a desired shape to form toner particles is carried out.

The aging treatment is specifically carried out by stirring with heating the dispersion in which associated particles are dispersed and adjusting the heating temperature, stirring rate, heating time, or the like until the shape of the associated particles has a desired circularity.

(d) Cooling Step

This step is a step for carrying out a cooling treatment of dispersion of toner particles. As for the conditions for cooling treatment, cooling rate is preferably 1 to 20° C./minute. Specific methods for cooling treatment are not particularly limited, and examples thereof include a method in which a coolant is introduced from an outside of a reaction vessel for cooling and a method in which cold water is directly added to a reaction system for cooling.

(e) Filtration and Washing Step

This step is a step in which toner particles are subjected to solid-liquid separation from cooled dispersion of toner particles, and an adhesive material such as surfactant or aggregation agent is removed from a toner cake obtained by solid-liquid separation (mass of toner particles in wet state which is aggregated in cake form) followed by washing.

The solid-liquid separation is not particularly limited, and a centrifugation, a reduced pressure filtration using Nutsche or the like, and a filtration using filter press or the like can be used.

(f) Drying Step

This step is a step for drying a toner cake after the washing treatment, and it can be carried out by following a drying step for a known method of producing toner particles which is generally carried out.

Specific examples of the dryer which is used for drying of a toner cake include a spray dryer, a freeze drying dryer, and a reduced pressure dryer. It is preferable to use a stationary tray dryer, a moving type tray dryer, a fluid bed dryer, a rotary type dryer, a stirring type dryer, or the like.

(g) Step for Adding External Additives

This step is a step which is carried out as required if external additives are added to toner particles.

As for a derive for mixing external additives, a mechanical mixing device like a HENSCHEL MIXER, a coffee mill, a sample mill or the like can be used.

<Developer (Developing Agent)>

Each of the black toner and color toner can be used as a magnetic or non-magnetic one-component developer. Alternatively, upon mixing with a carrier, it can be used as a two-component developer. When the toner is used as a two-component developer, a magnetic particle containing a conventionally known material including a metal such as iron, ferrite, or magnetite, and alloy of those metals with a metal like aluminum and lead can be used as a carrier. Ferrite is particularly preferable. Furthermore, as a carrier, a coat carrier in which a surface of magnetic particle is coated with a coating agent like resin, and a dispersion type carrier which is obtained by dispersing fine powder of magnetic body in a binder resin can be used.

The volume average particle diameter of a carrier is preferably 20 to 100 μm, and more preferably 25 to 80 μm. The volume average particle diameter of a carrier can be measured by HELOS (manufactured by Sympatec), which is a representative laser diffraction type particle size distribution analyzer equipped with a wet type disperser.

The two-component developer can be prepared by mixing the carrier with toner using a mixing device. Examples of the mixing device include HENSCHEL MIXER, NAUTA MIXER, and a V type mixer.

The blending amount of the toner for preparing the two-component developer according to the present invention is preferably 1 to 10% by mass relative to 100% by weight of the total of carrier and toner.

<Image Forming Method>

The image forming method of the present invention includes forming an image forming layer on a recording medium by using the aforementioned toner (toner for electrostatic latent image). Namely, provided by the present invention is an image forming method using yellow toner, magenta toner, cyan toner, and black toner in which each of the yellow toner, magenta toner, cyan toner, and black toner contains a crystalline polyester resin having a constitutional unit derived from a linear chain aliphatic diol, an amorphous resin, a colorant, and a releasing agent, a carbon number of a linear chain aliphatic diol component forming the crystalline polyester resin contained in the black toner is 6 or more, and a carbon number of a linear chain aliphatic diol component forming the crystalline polyester resin contained in each of the yellow toner, magenta toner, and cyan toner is 3 or more and 5 or less.

The image forming method of the present invention is a method in which 4 kinds of toner, yellow, magenta, cyan, and black toners, are used, and it can be suitably used for a full color image forming method. With regard to the full color image forming method, any image forming method can be used including a method in which a 4-cycle type image forming apparatus having 4 kinds of color developing apparatus which correspond to each of yellow, magenta, cyan, and black, and one electrostatic latent image support member (also referred to as "electrophotographic photoreceptor" or simply as "photoreceptor") is used and a method of using tandem type image forming apparatus in which an image forming unit having a color developing apparatus and an electrostatic latent image support member for each color is mounted for each color.

As for the image forming method, an image forming method including a fixing step based on heat and pressure fixing type, which allows heating simultaneously with pressure application, can be mentioned as a preferable example.

According to this image forming method, specifically, using the above toner, a toner image is obtained by developing an electrostatic latent image which is formed on a photoreceptor, for example, the toner image is transferred onto an image support member, and after that, by fixing the toner image transferred onto an image support member by a fixing treatment of a heat and pressure fixing type, and thus a printed matter having a visualized image formed thereon can be obtained.

The pressure application and heating for the fixing step are preferably carried out at the same time, but it is also possible that pressure is applied first, and then heating is carried out.

As described in the above, according to the image forming method of the present invention, a carbon number of a linear chain aliphatic diol component constituting the crystalline polyester resin that is contained in the black toner and color toner to be used is within a specific range. By using such black toner and color toner, the charging property of the black toner in high temperature and high humidity environment is enhanced and a good transfer property of the color toner in low temperature and low humidity environment can be obtained while maintaining good low temperature fixability. Furthermore, the image noise (fog) in high temperature and high humidity environment is also reduced.

Furthermore, the image forming method of the present invention is suitably used for an image forming method of heat and pressure fixing type. As for the fixing device of heat and pressure fixing type which is used for the image forming method of the present invention, various known ones can be employed. Hereinbelow, a fixing device of heat roller type and a fixing device of belt heating type are explained as a heat and pressure fixing device.

(i) Fixing Device of Heat Roller Type

The fixing device of heat roller type generally contains a roller pair consisting of a heating roller and a pressurizing roller in contact with the heating roller. According to this fixing device, deformation of the pressurizing roller is caused by the pressure applied between the heating roller and the pressurizing roller, and thus a so-called fixing nip part is formed on the deformation part.

The heating roller is generally formed by disposing a heat source like halogen lamp within a core metal consisting of hollow metal roller that is formed of aluminum or the like. In the heating roller, the core metal is heated by the heat source. At that time, its temperature is controlled as the electric conduction to the heat source is controlled such that the outer circumferential surface of the heating roller is maintained at a predetermined fixing temperature.

For a case in which the fixing device is used for an image forming apparatus for forming a full color image and thus it is required to have the ability to mix colors by sufficient heating and melting of a toner image composed of four toner layers (yellow, magenta, cyan, and black), it is preferable for the fixing device to have the following constitutions. Namely, the fixing device preferably has a heating roller in which a core metal has a high heat capacity and an elastic layer for even melting of a toner image is formed on an outer circumferential surface of the core metal.

Furthermore, the pressurizing roller has an elastic layer consisting of soft rubber like urethane rubber and silicone rubber, for example.

As for the pressurizing roller, a roller having a core metal consisting of hollow metal roller which is formed of aluminum or the like and an elastic layer formed on an outer circumferential surface of the core metal can be used.

Furthermore, when the pressurizing roller has a core metal, it may be configured as one in which a heat source like halogen lamp is arranged in the inside the core metal, similar to the heating roller. Furthermore, it is also possible to have a constitution in which, the temperature of the pressurizing roller is controlled according to heating of the core metal by heat source, and the electric conduction to the heat source is controlled such that the outer circumferential surface of the heating roller is maintained at a predetermined fixing temperature.

As for the heating roller and/or pressurizing roller, those obtained by forming, as the outermost layer thereof, a releasing layer consisting of a fluororesin such as polytetrafluoroethylene (PTFE) and tetrafluroethylene-perfluoroalkyl vinyl ether copolymer (PFA) are preferably used.

According to this fixing device of heat roller type, as the image support member for forming a visual image on a fixing nip part is conveyed in sandwiched state by rotating a pair of rollers, heating by heating roller and application of pressure at fixing nip part are carried out. Accordingly, an unfixed toner image is fixed on an image support member.

The image forming method of the present invention also has a characteristic of having excellent low temperature fixability. As such, temperature of the heating roller in the fixing device of heat roller type can be lowered to a relatively low level, and specifically, it can be lowered to 150° C. or lower. Furthermore, the temperature of the heating roller is preferably or 140° C. or lower, and more preferably 135° C. or lower. From the viewpoint of having excellent low temperature fixability, temperature of the heating roller is preferably as low as possible. Although the lower limit thereof is not particularly limited, it is substantially 90° C. or so.

(ii) Fixing Device of Belt Heating Type

The device of belt heating type generally contains a heating member such as a ceramic heater, a pressurizing roller, and a fixing belt formed of a heat resistant belt which is inserted between the heating member and pressurizing roller, and as deformation of the pressurizing roller is caused by the pressure applied between the heating member and pressurizing roller, a so-called fixing nip part is formed on the deformation part.

As for the fixing belt, a heat resistant belt, sheet, or the like formed of polyimide or the like can be used. Furthermore, the fixing belt can have a constitution in which a heat resistant belt, sheet, or the like formed of polyimide or the like is used as a substrate and a releasing layer consisting of a fluororesin such as polytetrafluoroethylene (PTFE) and tetrafluroethylene-perfluoroalkyl vinyl ether copolymer (PFA) is formed on the substrate. The fixing belt may have a constitution in which an elastic layer formed of rubber or the like is disposed between the substrate and releasing layer.

According to this fixing device of belt heating type, the image support member carrying an unfixed toner image is conveyed, together with the fixing belt, in sandwiched state between the fixing belt forming the fixing nip part and the pressurizing roller. Accordingly, heating by a heating body via the fixing belt and application of pressure at the fixing nip part are carried out, and thus an unfixed toner image is fixed on an image support member.

According to this fixing device of belt heating type, it is sufficient that, by having the electric conduction to the heating body at the time of forming an image only, the heating body is prepared in heated state with predetermined fixing temperature. Accordingly, the waiting time from input of a power source of an image forming apparatus to a state allowing actual image forming can be shortened. Furthermore, there are advantages that the power consumption during standby period of an image forming device is very small and power saving can be achieved, and the like.

As described in the above, the heating body, pressurizing roller, and fixing belt that are used as a fixing member of the fixing step preferably have a multilayer constitution.

According to the above fixing device of belt heating type, temperature of the heating body can be lowered to a relatively low level, and specifically, it can be lowered to 150° C. or lower. Furthermore, the temperature of the heating body is preferably or 140° C. or lower, and more preferably 135° C. or lower. From the viewpoint of having excellent low temperature fixability, temperature of the heating body is preferably as low as possible. Although the lower limit thereof is not particularly limited, it is substantially 90° C. or so.

(Recording Medium)

As for the recording medium (also referred to as recording material, recording paper, paper for recoding, or the like), a recording medium which is generally used can be used. As long as it can support a toner image which is formed by a known image forming method using an image forming device, for example, it is not particularly limited. Examples of the recording medium which is used as a usable image support member include regular paper including thin paper and thick paper, high quality paper, art paper, or a coated printing paper like coating paper, a commercially available Japanese paper or postcard paper, a plastic film for OHP, cloth, various resin material used for so-called soft packaging material, or resin film obtained by molding those materials to film shape, label, or the like.

Hereinabove, the embodiments of the present invention are explained. However, the present invention is not limited to the above embodiments, and various modifications can be added thereto.

Although the embodiments of the present invention are explained in detail, they are only for explanation and exemplification, and not limiting in any case, and it is evident that the scope of the present invention shall be interpreted based on the attached claims.

EXAMPLES

The effects of the present invention are explained by using the following Examples and Comparative examples. In the following Examples, "parts" and "%" means "parts by mass" and "% by mass", respectively, unless specifically described otherwise. Furthermore, unless specifically described otherwise, each operation was carried out at room temperature (25° C.). Furthermore, the present invention is not limited to the following Examples.

<Conditions for Each Analysis>

[Glass Transition Temperature of an Amorphous Resin and Melting Point of a Crystalline Resin]

The glass transition temperature (Tg) of an amorphous polyester resin and a vinyl resin (styrene acrylic resin) was measured by using "Diamond DSC" (manufactured by PerkinElmer Inc.). First, 3.0 mg of a measurement sample (resin) was sealed in an aluminum pan, and set in a sample holder of "Diamond DSC". As a reference, an empty aluminum pan was used. Then, a DSC curve was obtained under the following measurement conditions (temperature increasing and cooling conditions), that is, a first temperature increasing process in which temperature was increased from 0° C. to 200° C. at temperature increase rate of 10° C./minute, a cooling process in which temperature was decreased from 200° C. to 0° C. at temperature decrease rate of 10° C./minute, and a second temperature increasing process in which temperature was increased from 0° C. to 200° C. at temperature increase rate of 10° C./minute were performed in this order. Based on the DSC curve which has been obtained by this measurement, an extended line of a base line before the increase of a first endothermic peak in the second temperature increasing process and a tangent line representing the maximum slope between the increase part of a first peak to the peak top were drawn, and a cross point between those two lines was set as glass transition temperature (Tg).

Furthermore, as for the melting point of a crystalline polyester resin, based on a DSC curve obtained in the same manner as above, the temperature at peak top of an endothermic peak derived from a crystalline polyester resin during the second temperature increasing process (endothermic peak with half width of 15° C. or lower) was set as the melting point (Tm).

[Weight Average Molecular Weight and Number Average Molecular Weight of Resin]

The GPC-based molecular weight (weight average molecular weight and number average molecular weight) of each resin was measured as described below. Namely, apparatus "HLC-8120GPC (product manufactured by Tosoh Corporation) and column "TSKguardcolumn+TSKgelSuper HZ-M three-tiered" (product manufactured by Tosoh Corporation) were used, and while maintaining the column temperature at 40° C., tetrahydrofuran (THF) was flown as a carrier solvent at flow rate of 0.2 mL/minute. The measurement sample (resin) was dissolved in tetrahydrofuran such that it has concentration of 1 mg/ml. For preparing the solution, an ultrasonic disperser was used and a treatment was carried out for 5 minutes at room temperature. Subsequently, a sample solution was obtained by treatment using membrane filter with pore size of 0.2 μm. Then, 10 μL of this sample solution was injected to the apparatus together with a carrier solvent, and detection was made using a refractive index detector (RI detector). Molecular weight distribution of a measurement sample was calculated on the basis of a calibration curve which has been established using monodisperse polystyrene standard particles. As for the polystyrene for calibration measurement, 10 points were used.

<Preparation of Each Dispersion>

[Preparation Example 1]: Preparation of Dispersion of Crystalline Polyester Resin Particles [CP Dispersion 1]

<<Synthesis of Crystalline Polyester Resin [CP Resin 1]>>

To a four-necked flask equipped with an inlet for nitrogen, a dehydration tube, a stirring device, and a thermocouple, raw material monomers for the following polycondensation resin and 0.4 part by mass of $Ti(n\text{-}OBu)_4$ as an esterification catalyst were added, and the reaction was allowed to occur for 4 hours at 180° C.

| | |
|---|---|
| Ethylene glycol | 120 parts by mass |
| 1,12-Dodecane dicarboxylic acid | 400 parts by mass |

After that, the temperature was increased to 210° C. at temperature increase rate of 10° C. per hour followed by maintaining for 5 hours at 210° C. According to the reaction for 1 hour at reduced pressure (8 kPa), a crystalline polyester resin [CP resin 1] was obtained. The obtained crystalline polyester resin [CP resin 1] had number average molecular weight (Mn) of 5,000 and melting point of 83° C.

<<Preparation of Dispersion of Crystalline Polyester Resin Particles [CP Dispersion 1]>>

The crystalline polyester resin [CP resin 1] in an amount of 30 parts by mass was melt and, while still being remained in melt state, it was transferred at transfer rate of 100 parts by mass per minute to "CAVITRON CD1010" (manufactured by Eurotec limited), which was an emulsifying disperser. Furthermore, simultaneously with the transfer of the crystalline polyester resin [CP resin 1] in melt state, dilute ammonia water with concentration of 0.37% by mass (70 parts by mass of reagent ammonia water was diluted with ion exchange water in aqueous solvent tank) was transferred to the emulsifying disperser at transfer rate of 0.1 liter per minute under heating at 100° C. using a heat exchanger. Then, by operating the emulsifying disperser at conditions including rotor rotation rate of 60 Hz and pressure of 5 $kg/cm^2$, dispersion [CP dispersion 1] containing crystalline polyester resin particles with volume-based median diameter of 200 nm was prepared. Furthermore, the volume-based median diameter (D50) was measured by "UPA-150" (product of Nikkiso Co., Ltd.), which is MICROTRAC particle size distribution analyzer (ditto for the followings).

[Preparation Example 2 to 8]: Preparation of Dispersion of Crystalline Polyester Resin Particles [CP Dispersion 2] to [CP Dispersion 8]

Each of the crystalline polyester resins [CP resin 2] to [CP resin 8] was synthesized in the same manner as <<Synthesis of crystalline polyester resin [CP resin 1]>> above except that each of the type and addition amount of the raw material monomer used therein was changed to those described in the following Table 1. The number average molecular weight (Mn) and melting point of each CP resin are described in Table 1.

Subsequently, each of the dispersions of crystalline polyester resin particles [CP dispersion 2] to [CP dispersion 8] was prepared in the same manner as <<Preparation of dispersion of crystalline polyester resin particles [CP dispersion 1]>> above except that the CP resin used therein was changed to the crystalline polyester resin [CP resin 2] to [CP resin 8], respectively. Furthermore, the volume-based median diameter of the crystalline polyester resin particles contained in each dispersion was found to be within a range of 150 to 300 nm.

TABLE 1

| CP dispersion No. | CP resin No. | Composition of resin: Diol type | Addition amount [parts by mass] | Dicarboxylic acid type | Addition amount [parts by mass] | Number average molecular weight (Mn) | Melting point [° C.] |
|---|---|---|---|---|---|---|---|
| CP dispersion 1 | CP resin 1 | Ethylene glycol | 120 | 1,12-Dodecane dicarboxylic acid | 400 | 5,000 | 83 |
| CP dispersion 2 | CP resin 2 | 1,3 -Propane diol | 115 | 1,12-Dodecane dicarboxylic acid | 390 | 4,700 | 83 |
| CP Dispersion 3 | CP Resin 3 | 1,4-Butane diol | 130 | 1,12-Dodecane dicarboxylic acid | 370 | 5,100 | 75 |
| CP Dispersion 4 | CP Resin 4 | 1,5-Pentane diol | 145 | 1,12-Dodecane dicarboxylic acid | 360 | 5,300 | 75 |
| CP Dispersion 5 | CP Resin 5 | 1,6-Hexane diol | 155 | 1,12-Dodecane dicarboxylic acid | 340 | 5,000 | 76 |
| CP dispersion 6 | CP resin 6 | 1,9-Nonane diol | 190 | 1,12-Dodecane dicarboxylic acid | 305 | 4,400 | 77 |
| CP Dispersion 7 | CP Resin 7 | 1,12-Dodecane diol | 220 | 1,12-Dodecane dicarboxylic acid | 280 | 4,600 | 83 |
| CP Dispersion 8 | CP Resin 8 | 1,14-Tetradecane diol | 235 | 1,12-Dodecane dicarboxylic acid | 265 | 4,800 | 85 |

[Preparation Example 9]: Preparation of Dispersion of Amorphous Polyester Resin Particles [AP Dispersion 1]

<<Synthesis of Amorphous Polyester Resin [AP Resin 1]>>

To a four-necked flask equipped with an inlet for nitrogen, a dehydration tube, a stirring device, and a thermocouple, raw material monomers for the following polycondensation resin and 1.0 part by mass of $Ti(n\text{-}OBu)_4$ as an esterification catalyst were added, and the reaction was allowed to occur for 4 hours at 180° C.

| | |
|---|---|
| Fumaric acid | 132 parts by mass |
| Terephthalic acid | 45 parts by mass |
| Bisphenol A propylene oxide 2 mole adduct | 500 parts by mass |

After that, the temperature was increased to 210° C. at temperature increase rate of 10° C. per hour followed by maintaining for 5 hours at 210° C. Then, the reaction was allowed to occur for 1 hour at reduced pressure (8 kPa). Next, after cooling to 200° C. and according to the reaction for 1 hour at reduced pressure (20 kPa), an amorphous polyester resin [AP resin 1] was obtained. The obtained amorphous polyester resin [AP resin 1] had weight average molecular weight (Mw) of 35,000 and glass transition temperature (Tg) of 58° C.

<<Preparation of Dispersion of Amorphous Polyester Resin Particles [AP Dispersion 1]>>

The amorphous polyester resin [AP resin 1] in an amount of 30 parts by mass was melt and, while still being remained in melt state, it was transferred at transfer rate of 100 parts by mass per minute to "CAVITRON CD1010" (manufactured by Eurotec limited), which is an emulsifying disperser. Furthermore, simultaneously with the transfer of the amorphous polyester resin [AP resin 1] in melt state, dilute ammonia water with concentration of 0.37% by mass (70 parts by mass of reagent ammonia water was diluted with ion exchange water in aqueous solvent tank) was transferred to the emulsifying disperser at transfer rate of 0.1 liter per minute under heating at 100° C. using a heat exchanger. Then, by operating the emulsifying disperser at conditions including rotor rotation rate of 60 Hz and pressure of 5 $kg/cm^2$, dispersion [AP dispersion 1] containing amorphous polyester resin particles with volume-based median diameter of 180 nm was prepared.

[Preparation Example 10]: Preparation of Dispersion of Styrene Acrylic Resin Particles [AS Dispersion 1]

To a reaction vessel equipped with a stirring device, a temperature sensor, a cooling tube, and an inlet for nitrogen, 8 parts by mass of sodium dodecylsulfate and 2733 parts by mass of ion exchange water were added. Then, with stirring at stirring rate of 230 rpm under nitrogen stream, the internal temperature was raised to 80° C. After increasing the temperature, an aqueous solution in which 10 parts by mass of potassium peroxobisulfate were dissolved in 200 parts by mass of ion exchange water was added, and the liquid temperature was again adjusted to 80° C.

After that, a monomer mixture consisting of the followings was added dropwise thereto over 1 hour.

| | |
|---|---|
| Styrene | 620 parts by mass |
| n-Butylacrylate | 160 parts by mass |
| Methacrylic acid | 40 parts by mass |
| n-Octylmercaptan | 8 parts by mass |

Then, according to heating and stirring for 2 hours at 80° C., the polymerization was carried out. After that, by cooling to 20° C., dispersion of an amorphous resin consisting of styrene acrylic resin [AS dispersion 1] was prepared.

With regard to the obtained aqueous dispersion of styrene acrylic resin particles, the volume-based median diameter of styrene acrylic resin particle was found to be 150 nm, glass transition temperature (Tg) was found to be 59° C., and weight average molecular weight (Mw) was found to be 32,000.

[Preparation Example 11]: Preparation of Dispersion of Releasing Agent Particles [W1]

| | |
|---|---|
| Paraffin wax (HNP0190, product of Nippon Seiro Co., Ltd. (melting point: 85° C.)) | 200 parts by mass |
| Sodium dodecylsulfate | 20 parts by mass |
| Ion exchange water | 2200 parts by mass |

The above materials were admixed with one another, heated to 95° C., and sufficiently dispersed by using ULTRA-TURRAX (registered trademark, ditto for the followings) T-50 manufactured by IKA Co., Ltd. After that, according to dispersion treatment using a pressure ejection type GAULIN homogenizer, dispersion of releasing agent particles [W1] was prepared. The volume-based median diameter of releasing agent particle in this dispersion was found to be 100 nm.

[Preparation Example 12]: Preparation of Dispersion of Black Colorant Particles [Bk]

| | |
|---|---|
| Sodium dodecylsulfate | 90 parts by mass |
| Carbon black "REGAL" (registered trademark) 330R" (manufactured by Cabot Corporation) | 200 parts by mass |
| Ion exchange water | 1600 parts by mass |

A mixture having the above components mixed therein was sufficiently dispersed by ULTRA-TURRAX T-50 (manufactured by IKA Co., Ltd.) followed by a treatment with ultrasonic disperser for 20 minutes to prepare dispersion of black colorant particles [Bk].

With regard to the obtained dispersion of black colorant particles [Bk], the volume-based median diameter of colorant particle was found to be 110 nm.

[Preparation Example 13]: Dispersion of Yellow Colorant Particles [Ye]

| | |
|---|---|
| Sodium dodecylsulfate | 90 parts by mass |
| C.I. Pigment Yellow 74 | 200 parts by mass |
| Ion exchange water | 1600 parts by mass |

A mixture having the above components mixed therein was sufficiently dispersed by ULTRA-TURRAX T-50 (manufactured by IKA Co., Ltd.) followed by a treatment with ultrasonic disperser for 20 minutes to prepare dispersion of yellow colorant particles [Ye].

With regard to the obtained dispersion of yellow colorant particles [Ye], the volume-based median diameter of colorant particle was found to be 240 nm.

[Preparation Example 14]: Dispersion of Magenta Colorant Particles [Ma]

| | |
|---|---|
| Sodium dodecylsulfate | 90 parts by mass |
| C.I. Pigment Red 269 | 200 parts by mass |
| Ion exchange water | 1600 parts by mass |

A mixture having the above components mixed therein was sufficiently dispersed by ULTRA-TURRAX T-50 (manufactured by IKA Co., Ltd.) followed by a treatment with ultrasonic disperser for 20 minutes to prepare dispersion of magenta colorant particles [Ma].

With regard to the obtained dispersion of magenta colorant particles [Ma], the volume-based median diameter of colorant particle was found to be 200 nm.

[Preparation Example 15]: Dispersion of Cyan Colorant Particles [Cy]

| | |
|---|---|
| Sodium dodecylsulfate | 90 parts by mass |
| C.I. Pigment Blue 15:3 | 200 parts by mass |
| Ion exchange water | 1600 parts by mass |

A mixture having the above components mixed therein was sufficiently dispersed by ULTRA-TURRAX T-50 (manufactured by IKA Co., Ltd.) followed by a treatment with ultrasonic disperser for 20 minutes to prepare dispersion of cyan colorant particles [Cy].

With regard to the obtained dispersion of cyan colorant particles [Cy], the volume-based median diameter of colorant particle was found to be 180 nm.

<Preparation of Each Toner (Developer)>

[Preparation of Black Developer [1]]

<<Aggregation-Fusion Step and Aging Step>>

To a reaction vessel provided with a stirring device, a temperature sensor, and a cooling tube, 36 parts by mass (in terms of solid content) of aqueous dispersion of crystalline polyester resin particles [CP dispersion 5], 504 parts by mass (in terms of solid content) of dispersion of styrene acrylic resin particles [AS dispersion 1], 48 parts by mass (in terms of solid content) of dispersion of colorant particles [Bk], and 60 parts by mass (in terms of solid content) of dispersion of releasing agent particles [W1] were added. After that, by adding 5 mol/liter aqueous solution of sodium hydroxide thereto, pH was adjusted to 10.

Subsequently, an aqueous solution in which 50 parts by mass of magnesium chloride was dissolved in 50 parts by mass of ion exchange water was added thereto over 10 minutes at 30° C. under stirring. Increasing the temperature was initiated, and the mixture was heated to 80° C. over 60 minutes. By using "COULTER MULTISIZER 3" (manufactured by Beckman Coulter Inc.), particle diameter of associated particle was measured. The stirring rate was controlled such that the volume-based median diameter was 6.0 μm. After that, by adding an aqueous solution in which 190 parts by mass of sodium chloride was dissolved in 760 parts by mass of ion exchange water thereto, particle growth was terminated. Furthermore, according to heating and stirring in 80° C. state, fusion of particles was allowed to progress.

<<Cooling Step>>

After that, when the average circularity becomes 0.957 as measured by using "FPIA-3000" (manufactured by Sysmex Corporation), which is a device for measuring average circularity of toner particle (HPF detection number: 4000 pieces), cooling to 30° C. was performed with cooling rate of 1° C./minute.

<<Filtering and Washing Step and Drying Step>>

Subsequently, after solid-liquid separation, an operation of having re-dispersion of dehydrated toner cake in ion exchange water followed by solid-liquid separation was repeated 3 times for washing. Then, by drying for 24 hours at 40° C., the black toner particles [1X] were obtained.

<<Step for Adding External Additives>>

To 100 parts by mass of the toner particles [1X], 0.6 part by mass of hydrophobic silica (number average primary particle diameter=12 nm, hydrophobicity degree=68) and 1.0 part by mass of hydrophobic titanium oxide (number average primary particle diameter=20 nm, hydrophobicity degree=63) were added, and mixed for 20 minutes at 32° C. with stirring wing speed of 35 msec using "Henschel mixer"

(manufactured by Mitsui Miike Machinery Co., Ltd.). Subsequently, coarse particles were removed by using a sieve with opening size of 45 μm. As a result, the black toner [1] was obtained. Furthermore, the number average primary particle of each of the above external additives was obtained according to the above method.

<<Step for Preparing Developer>>

The black developer [1] was obtained by adding ferrite carrier that was coated with copolymer of cyclohexyl methacrylate and methyl methacrylate (monomer mass ratio=1:1) and had a volume-based average particle diameter of 30 μm to the black toner [1] so as to have a toner concentration of 6% by mass and mixing them together.

[Preparation of Black Developers [2] to [9]]

Each of the black developers [2] to [9] was prepared in the same manner as above except that, with regard to the above [Preparation of black developer [1]], each of the type and use amount of a dispersion (resin) to be used was changed as described in Table 2.

[Preparation of Yellow Developers [1] to [9]]

Each of the yellow developers [1] to [9] was prepared in the same manner as above except that, with regard to the above [Preparation of black developer [1]], each of the type and use amount of a dispersion (resin) to be used and each of the type and use amount of a colorant were changed as described in Table 3.

[Preparation of Magenta Developers [1] to [9]]

Each of the magenta developers [1] to [9] was prepared in the same manner as above except that, with regard to the above [Preparation of black developer [1]], each of the type and use amount of a dispersion (resin) to be used and each of the type and use amount of a colorant were changed as described in Table 4.

[Preparation of Cyan Developers [1] to [9]]

Each of the cyan developers [1] to [9] was prepared in the same manner as above except that, with regard to the above [Preparation of black developer [1]], each of the type and use amount of a dispersion (resin) to be used and each of the type and use amount of a colorant were changed as described in Table 5.

TABLE 2

| | | CP dispersion | | Dispersion of amorphous resin | | | |
|---|---|---|---|---|---|---|---|
| Black developer No. | Black toner No. | No. | Amount of crystalline polyester resin (in terms of solid content) [parts by mass] | No. | Amount of amorphous resin (in terms of solid content) [parts by mass] | Amount of releasing agent (in terms of solid content) [parts by mass] | Amount of colorant (Bk) (in terms of solid content) [parts by mass] |
| Black developer [1] | Black toner [1] | CP dispersion 5 | 36 | AS dispersion 1 | 504 | 60 | 48 |
| Black developer [2] | Black toner [2] | CP dispersion 8 | 36 | AS dispersion 1 | 504 | 60 | 48 |
| Black developer [3] | Black toner [3] | CP dispersion 7 | 36 | AS dispersion 1 | 504 | 60 | 48 |
| Black developer [4] | Black toner [4] | CP dispersion 6 | 36 | AS dispersion 1 | 504 | 60 | 48 |
| Black developer [5] | Black toner [5] | CP dispersion 6 | 90 | AS dispersion 1 | 450 | 60 | 48 |
| Black developer [6] | Black toner [6] | CP dispersion 6 | 24 | AS dispersion 1 | 516 | 60 | 48 |
| Black developer [7] | Black toner [7] | CP dispersion 6 | 102 | AS dispersion 1 | 438 | 60 | 48 |
| Black developer [8] | Black toner [8] | CP dispersion 3 | 36 | AS dispersion 1 | 504 | 60 | 48 |
| Black developer [9] | Black toner [9] | CP dispersion 6 | 36 | AP dispersion 1 | 504 | 60 | 48 |

TABLE 3

| | | CP dispersion | | Dispersion of amorphous resin | | | |
|---|---|---|---|---|---|---|---|
| Yellow developer No. | Yellow toner No. | No. | Amount of crystalline polyester resin (in terms of solid content) [parts by mass] | No. | Amount of amorphous resin (in terms of solid content) [parts by mass] | Amount of releasing agent (in terms of solid content) [parts by mass] | Amount of colorant (Ye) (in terms of solid content) [parts by mass] |
| Yellow developer [1] | Yellow toner [1] | CP dispersion 2 | 36 | AS dispersion 1 | 504 | 60 | 36 |
| Yellow developer [2] | Yellow toner [2] | CP dispersion 3 | 36 | AS dispersion 1 | 504 | 60 | 36 |
| Yellow developer [3] | Yellow toner [3] | CP dispersion 4 | 36 | AS dispersion 1 | 504 | 60 | 36 |
| Yellow developer [4] | Yellow toner [4] | CP dispersion 4 | 90 | AS dispersion 1 | 450 | 60 | 36 |
| Yellow developer [5] | Yellow toner [5] | CP dispersion 4 | 24 | AS dispersion 1 | 516 | 60 | 36 |
| Yellow developer [6] | Yellow toner [6] | CP dispersion 4 | 102 | AS dispersion 1 | 438 | 60 | 36 |
| Yellow developer [7] | Yellow toner [7] | CP dispersion 1 | 36 | AS dispersion 1 | 504 | 60 | 36 |
| Yellow developer [8] | Yellow toner [8] | CP dispersion 5 | 36 | AS dispersion 1 | 504 | 60 | 36 |
| Yellow developer [9] | Yellow toner [9] | CP dispersion 4 | 36 | AP dispersion 1 | 504 | 60 | 36 |

TABLE 4

| | | CP dispersion | | Dispersion of amorphous resin | | | |
|---|---|---|---|---|---|---|---|
| Magenta developer No. | Magenta toner No. | No. | Amount of crystalline polyester resin (in terms of solid content) [parts by mass] | No. | Amount of amorphous resin (in terms of solid content) [parts by mass] | Amount of releasing agent (in terms of solid content) [parts by mass] | Amount of colorant (Ma) (in terms of solid content) [parts by mass] |
| Magenta developer [1] | Magenta toner [1] | CP dispersion 2 | 36 | AS dispersion 1 | 504 | 60 | 36 |
| Magenta developer [2] | Magenta toner [2] | CP dispersion 3 | 36 | AS dispersion 1 | 504 | 60 | 36 |
| Magenta developer [3] | Magenta toner [3] | CP dispersion 4 | 36 | AS dispersion 1 | 504 | 60 | 36 |
| Magenta developer [4] | Magenta toner [4] | CP dispersion 4 | 90 | AS dispersion 1 | 450 | 60 | 36 |
| Magenta developer [5] | Magenta toner [5] | CP dispersion 4 | 24 | AS dispersion 1 | 516 | 60 | 36 |
| Magenta developer [6] | Magenta toner [6] | CP dispersion 4 | 102 | AS dispersion 1 | 438 | 60 | 36 |
| Magenta developer [7] | Magenta toner [7] | CP dispersion 1 | 36 | AS dispersion 1 | 504 | 60 | 36 |
| Magenta developer [8] | Magenta toner [8] | CP dispersion 5 | 36 | AS dispersion 1 | 504 | 60 | 36 |
| Magenta developer [9] | Magenta toner [9] | CP dispersion 4 | 36 | AP dispersion 1 | 504 | 60 | 36 |

TABLE 5

| | | CP dispersion | | Dispersion of amorphous resin | | | |
|---|---|---|---|---|---|---|---|
| Cyan developer No. | Cyan toner No. | No. | Amount of crystalline polyester resin (in terms of solid content) [parts by mass] | No. | Amount of amorphous resin (in terms of solid content) [parts by mass] | Amount of releasing agent (in terms of solid content) [parts by mass] | Amount of colorant (Cy) (in terms of solid content) [parts by mass] |
| Cyan developer [1] | Cyan toner [1] | CP dispersion 2 | 36 | AS dispersion 1 | 504 | 60 | 36 |
| Cyan developer [2] | Cyan toner [2] | CP dispersion 3 | 36 | AS dispersion 1 | 504 | 60 | 36 |
| Cyan developer [3] | Cyan toner [3] | CP dispersion 4 | 36 | AS dispersion 1 | 504 | 60 | 36 |
| Cyan developer [4] | Cyan toner [4] | CP dispersion 4 | 90 | AS dispersion 1 | 450 | 60 | 36 |
| Cyan developer [5] | Cyan toner [5] | CP dispersion 4 | 24 | AS dispersion 1 | 516 | 60 | 36 |
| Cyan developer [6] | Cyan toner [6] | CP dispersion 4 | 102 | AS dispersion 1 | 438 | 60 | 36 |
| Cyan developer [7] | Cyan toner [7] | CP dispersion 1 | 36 | AS dispersion 1 | 504 | 60 | 36 |
| Cyan developer [8] | Cyan toner [8] | CP dispersion 5 | 36 | AS dispersion 1 | 504 | 60 | 36 |
| Cyan developer [9] | Cyan toner [9] | CP dispersion 4 | 36 | AP dispersion 1 | 504 | 60 | 36 |

<Evaluation>

By using the developer prepared in the above, each evaluation was carried out for the combinations that are shown in the following Table 6. The results are shown in Table 7. Furthermore, the description of "CP amount" in Table 7 indicates the amount (% by mass) of a crystalline polyester resin relative to the total mass of a crystalline polyester resin (CP), an amorphous resin (amorphous polyester resin (AP) or styrene acrylic resin (AS)), and a releasing agent. Furthermore, in Table 7, "Overall evaluation" based on each of the following evaluations was given according to 5 levels. When the score was 2 or higher, it is judged to be acceptable.

TABLE 6

| | Black developer No. | Color developer set No. | | |
|---|---|---|---|---|
| Example 1 | Black developer [1] | Color developer set [1] | | |
| | | Yellow developer [1] | Magenta developer [1] | Cyan developer [1] |
| Example 2 | Black developer [1] | Color developer set [2] | | |
| | | Yellow developer [2] | Magenta developer [2] | Cyan developer [2] |
| Example 3 | Black developer [1] | Color developer set [3] | | |
| | | Yellow developer [3] | Magenta developer [3] | Cyan developer [3] |
| Example 4 | Black developer [2] | Color developer set [1] | | |
| | | Yellow developer [1] | Magenta developer [1] | Cyan developer [1] |
| Example 5 | Black developer [2] | Color developer set [3] | | |
| | | Yellow developer [3] | Magenta developer [3] | Cyan developer [3] |
| Example 6 | Black developer [3] | Color developer set [1] | | |
| | | Yellow developer [1] | Magenta developer [1] | Cyan developer [1] |
| Example 7 | Black developer [3] | Color developer set [3] | | |
| | | Yellow developer [3] | Magenta developer [3] | Cyan developer [3] |
| Example 8 | Black developer [4] | Color developer set [1] | | |
| | | Yellow developer [1] | Magenta developer [1] | Cyan developer [1] |

TABLE 6-continued

| | Black developer No. | Color developer set No. | | |
|---|---|---|---|---|
| Example 9 | Black developer [4] | Color developer set [3] | | |
| | | Yellow developer [3] | Magenta developer [3] | Cyan developer [3] |
| Example 10 | Black developer [5] | Color developer set [4] | | |
| | | Yellow developer [4] | Magenta developer [4] | Cyan developer [4] |
| Example 11 | Black developer [6] | Color developer set [5] | | |
| | | Yellow developer [5] | Magenta developer [5] | Cyan developer [5] |
| Example 12 | Black developer [7] | Color developer set [6] | | |
| | | Yellow developer [6] | Magenta developer [6] | Cyan developer [6] |
| Example 13 | Black developer [9] | Color developer set [9] | | |
| | | Yellow developer [9] | Magenta developer [9] | Cyan developer [9] |
| Comparative Example 1 | Black developer [8] | Color developer set [1] | | |
| | | Yellow developer [1] | Magenta developer [1] | Cyan developer [1] |
| Comparative Example 2 | Black developer [8] | Color developer set [3] | | |
| | | Yellow developer [3] | Magenta developer [3] | Cyan developer [3] |
| Comparative Example 3 | Black developer [1] | Color developer set [7] | | |
| | | Yellow developer [7] | Yellow developer [7] | Cyan developer [7] |
| Comparative Example 4 | Black developer [1] | Color developer set [8] | | |
| | | Yellow developer [8] | Magenta developer [8] | Cyan developer [8] |
| Comparative Example 5 | Black developer [3] | Color developer set [7] | | |
| | | Yellow developer [7] | Magenta developer [7] | Cyan developer [7] |
| Comparative Example 6 | Black developer [3] | Color developer set [8] | | |
| | | Yellow developer [8] | Magenta developer [8] | Cyan developer [8] |

[Low Temperature Fixability]

The fixing device of a copying machine "BIZHUB PRESS (registered trademark) C1070" (product of Konica Minolta Inc.) was modified such that the surface temperature (fixing temperature) of a heating roller can be varied within a range of 120 to 180° C. Each of the developers was loaded in the copying machine according to the combination of the above Table 6, and then the evaluation was carried out.

First, under room temperature and normal humidity (temperature of 20° C., and humidity of 50% RH) environment, the deposition amount of a black image on A4 size high quality paper "CF paper" (product of Konica Minolta Inc.) was set at 4.0 g/m$^2$. After that, a fixing test for fixing 4-color image with a size of 100 mm×100 mm was repeatedly carried out to 180° C. while changing the fixing temperature to be set from 120° C. so as to increase by 1° C.

The printed matter at each fixing temperature obtained from above was examined by a visual examination, and the lowest temperature at which every toner was fixed on the paper without being adhered on the fixing device was defined as the lowest fixing temperature (° C.). The results are shown in Table 7. Furthermore, those showing the lowest fixing temperature of 150° C. or lower are judged to be acceptable.

[Image Noise (Fog Concentration)]

Each of the developers was loaded according to the combination of the above Table 6 in a copying machine "BIZHUB PRESS (registered trademark) C1070" (product of Konica Minolta Inc.), and then the evaluation was carried out.

First, under high temperature and high humidity (temperature of 30° C., and humidity of 80% RH) environment, the developer within a developer was mixed by stirring for 60 minutes. After that, by feeding an A3 size high quality paper "CF paper" (product of Konica Minolta Inc.) at conditions of printing rate of 0%, a white paper was obtained. The image density at 20 areas in the obtained white paper was measured by a densitometer "FD-7" (product of Konica Minolta Inc.), and the average value was obtained as white paper density. The results are shown in the following Table 7. Furthermore, those having the obtained white paper density of 0.020 or lower are judged to be acceptable.

[Image Density (Image Density Under High Temperature and High Humidity Environment and Low Temperature and Low Humidity Environment)]

Evaluation was carried out by using a copying machine "BIZHUB PRESS (registered trademark) C1070" (product of Konica Minolta Inc.), which has been modified to nullify the control of temperature and humidity calibration, and by loading each of the prepared developers in combination of the above Table 6.

First, under room temperature and normal humidity (temperature of 20° C., and humidity of 50% RH) environment, the deposition amount of a black image on A4 size high quality paper "CF paper" (product of Konica Minolta Inc.) was set at 4.0 g/m$^2$. Similarly, setting was made such that the deposition amount of an image in which the yellow, magenta, and cyan toner were overlaid (hereinbelow, referred to as a "3C image") was 9.0 g/m$^2$. At that time, an adjustment was made such that there was no difference in the deposition amount of the yellow, magenta, and cyan toner.

After that, under high temperature and high humidity (temperature of 30° C., and humidity of 80% RH) environment and low temperature and normal humidity (temperature of 10° C., and humidity of 20% RH) environment, each of the black image and 3C image with a size of 100 mm×100 mm was printed on A4 size high quality paper "CF paper".

Transmission density was measured for each of the black image and 3C image, which have been obtained under high temperature and high humidity environment or low temperature and normal humidity environment, by using a transmission densitometer TD904 (manufactured by Macbeth). The results are shown in the following Table 7. Furthermore, for each environment, those showing that each of the measured black image density and 3C image density was 0.90 or higher are judged to be acceptable.

TABLE 7

| | Carbon number of linear chain aliphatic alcohol of CP | | CP amount | CP amount | | Evaluation result | |
|---|---|---|---|---|---|---|---|
| | Black toner | Color toner | (black toner) [% by mass] | (color toner) [% by mass] | Type of amorphous resin | Lowest fixing temperature [° C.] | Evaluation of fog |
| Example 1 | 6 | 3 | 6 | 6 | AS (black • color) | 133 | 0.013 |
| Example 2 | 6 | 4 | 6 | 6 | AS (black • color) | 134 | 0.007 |
| Example 3 | 6 | 5 | 6 | 6 | AS (black • color) | 134 | 0.006 |
| Example 4 | 14 | 3 | 6 | 6 | AS (black • color) | 146 | 0.012 |
| Example 5 | 14 | 5 | 6 | 6 | AS (black • color) | 147 | 0.006 |
| Example 6 | 12 | 3 | 6 | 6 | AS (black • color) | 144 | 0.012 |
| Example 7 | 12 | 5 | 6 | 6 | AS (black • color) | 143 | 0.007 |
| Example 8 | 9 | 3 | 6 | 6 | AS (black • color) | 138 | 0.014 |
| Example 9 | 9 | 5 | 6 | 6 | AS (black • color) | 137 | 0.006 |
| Example 10 | 9 | 5 | 15 | 15 | AS (black • color) | 135 | 0.008 |
| Example 11 | 9 | 5 | 4 | 4 | AS (black • color) | 140 | 0.003 |
| Example 12 | 9 | 5 | 17 | 17 | AS (black • color) | 133 | 0.010 |
| Example 13 | 9 | 5 | 6 | 6 | AP (black • color) | 139 | 0.006 |
| Comparative Example 1 | 4 | 3 | 6 | 6 | AS (black • color) | 130 | 0.013 |
| Comparative Example 2 | 4 | 5 | 6 | 6 | AS (black • color) | 129 | 0.007 |
| Comparative Example 3 | 6 | 2 | 6 | 6 | AS (black • color) | 132 | 0.022 |
| Comparative Example 4 | 6 | 6 | 6 | 6 | AS (black • color) | 133 | 0.001 |
| Comparative Example 5 | 12 | 2 | 6 | 6 | AS (black • color) | 142 | 0.024 |
| Comparative Example 6 | 12 | 6 | 6 | 6 | AS (black • color) | 143 | 0.002 |

| | Evaluation result | | | | |
|---|---|---|---|---|---|
| | Under high temperature and high humidity environment | | Under low temperature and low humidity environment | | |
| | Black image density | Color image density | Black image density | Color image density | Overall evaluation |
| Example 1 | 1.05 | 1.11 | 1.08 | 1.08 | 2 |
| Example 2 | 1.05 | 1.10 | 1.11 | 1.07 | 5 |
| Example 3 | 1.04 | 1.10 | 1.09 | 1.03 | 5 |
| Example 4 | 1.12 | 1.08 | 1.11 | 1.09 | 2 |
| Example 5 | 1.11 | 1.09 | 1.10 | 1.04 | 4 |
| Example 6 | 1.09 | 1.08 | 1.11 | 1.08 | 3 |
| Example 7 | 1.10 | 1.11 | 1.10 | 1.04 | 3 |
| Example 8 | 1.08 | 1.09 | 1.12 | 1.09 | 3 |
| Example 9 | 1.07 | 1.11 | 1.11 | 1.01 | 3 |
| Example 10 | 1.07 | 1.10 | 1.09 | 1.03 | 4 |
| Example 11 | 1.06 | 1.12 | 1.08 | 1.01 | 3 |
| Example 12 | 1.07 | 1.11 | 1.10 | 1.02 | 3 |
| Example 13 | 1.08 | 1.09 | 1.11 | 1.00 | 2 |
| Comparative Example 1 | 0.78 | 1.10 | 1.08 | 1.08 | 1 |
| Comparative Example 2 | 0.75 | 1.09 | 1.09 | 1.03 | 1 |
| Comparative Example 3 | 1.04 | 1.08 | 1.08 | 1.10 | 1 |
| Comparative Example 4 | 1.05 | 1.10 | 1.11 | 0.82 | 1 |
| Comparative Example 5 | 1.09 | 1.11 | 1.08 | 1.11 | 1 |
| Comparative Example 6 | 1.08 | 1.09 | 1.10 | 0.80 | 1 |

From the results shown in the above Table 7, it was shown that the image formed by using the toner set (image forming method) of Examples 1 to 13 has suppressed image noise and reduced environment dependent property of image density while favorable low temperature fixability was maintained.

On the other hand, it was shown that the image formed by using the toner set (image forming method) of Comparative examples 1 to 6 cannot achieve all of maintaining favorable low temperature fixability, suppression of image noise, and reduction of environment dependent property of image density, and any of those properties was impaired.

Japanese Patent Application No. 2016-235183 including the description, claims, and abstract, which has been filed on Dec. 2, 2016, is incorporated herein by reference in its entirety.

What is claimed is:

1. An image forming method comprising forming image forming layers from yellow toner, magenta toner, cyan toner, and black toner on a recording medium, wherein each of the yellow toner, the magenta toner, the cyan toner, and the black toner comprises a crystalline polyester resin having a constitutional unit derived from a linear chain aliphatic diol, an amorphous resin, a colorant, and a releasing agent, a carbon number of a linear chain aliphatic diol component forming the crystalline polyester resin contained in the black toner is 6 or more, and a carbon number of a linear chain aliphatic diol component forming the crystalline polyester resin contained in each of the yellow toner, the magenta toner, and the cyan toner is 3 or more and 5 or less.

2. The image forming method according to claim 1, wherein the carbon number of the linear chain aliphatic diol component forming the crystalline polyester resin contained in the black toner is 12 or less.

3. The image forming method according to claim 1, wherein the carbon number of the linear chain aliphatic diol component forming the crystalline polyester resin contained in the black toner is 9 or less.

4. The image forming method according to claim 1, wherein each of the yellow toner, the magenta toner, the cyan toner, and the black toner comprises 6 to 15% by mass of the crystalline polyester resin relative to the total mass of the crystalline polyester resin, the amorphous resin, and the releasing agent.

5. The image forming method according to claim 1, wherein the amorphous resin contained in each of the yellow toner, the magenta toner, the cyan toner, and the black toner comprises a styrene acrylic resin.

6. The image forming method according to claim 1, wherein the carbon number of the linear chain aliphatic diol component forming the crystalline polyester resin contained in each of the yellow toner, the magenta toner, and the cyan toner is 4 or 5.

7. The image forming method according to claim 1, wherein $C_{Ye}$, $C_{Ma}$, $C_{Cy}$ and $C_{Bk}$ satisfy the following formulas (1) to (3), wherein $C_{Ye}$ is the carbon number of the linear chain aliphatic diol component forming the crystalline polyester resin contained in the yellow toner, $C_{Ma}$ is the carbon number of the linear chain aliphatic diol component forming the crystalline polyester resin contained in the magenta toner, $C_{Cy}$ is the carbon number of the linear chain aliphatic diol component forming the crystalline polyester resin contained in the cyan toner, and $C_{Bk}$ is the carbon number of the linear chain aliphatic diol component forming the crystalline polyester resin contained in the black toner, $$1 \leq C_{Bk} - C_{Ye} \leq 6 \quad (1)$$

$$1 \leq C_{Bk} - C_{Ma} \leq 6 \quad (2)$$

$$1 \leq C_{Bk} - C_{Cy} \leq 6 \quad (3).$$

8. The image forming method according to claim 1, wherein $C_{Ye}$, $C_{Ma}$, $C_{Cy}$ and $C_{Bk}$ satisfy the following formulas (4) to (6), wherein $C_{Ye}$ is the carbon number of the linear chain aliphatic diol component forming the crystalline polyester resin contained in the yellow toner, $C_{Ma}$ is the carbon number of the linear chain aliphatic diol component forming the crystalline polyester resin contained in the magenta toner, $C_{Cy}$ is the carbon number of the linear chain aliphatic diol component forming the crystalline polyester resin contained in the cyan toner, and $C_{Bk}$ is the carbon number of the linear chain aliphatic diol component forming the crystalline polyester resin contained in the black toner, $$2 \leq C_{Bk} - C_{Ye} \leq 4 \quad (4)$$

$$2 \leq C_{Bk} - C_{Ma} \leq 4 \quad (5)$$

$$2 \leq C_{Bk} - C_{Cy} \leq 4 \quad (6).$$

9. A toner set for developing an electrostatic latent image comprising yellow toner, magenta toner, cyan toner, and black toner, wherein each of the yellow toner, the magenta toner, the cyan toner, and the black toner comprises a crystalline polyester resin having a constitutional unit derived from a linear chain aliphatic diol, an amorphous resin, a colorant, and a releasing agent, a carbon number of a linear chain aliphatic diol component forming the crystalline polyester resin contained in the black toner is 6 or more, and a carbon number of a linear chain aliphatic diol component forming the crystalline polyester resin contained in each of the yellow toner, the magenta toner, and the cyan toner is 3 or more and 5 or less.

10. The toner set for developing an electrostatic latent image according to claim 9, wherein the carbon number of the linear chain aliphatic diol component forming the crystalline polyester resin contained in the black toner is 12 or less.

11. The toner set for developing an electrostatic latent image according to claim 9, wherein the carbon number of the linear chain aliphatic diol component forming the crystalline polyester resin contained in the black toner is 9 or less.

12. The toner set for developing an electrostatic latent image according to claim 9, wherein each of the yellow toner, the magenta toner, the cyan toner, and the black toner comprises 6 to 15% by mass of the crystalline polyester resin relative to the total mass of the crystalline polyester resin, the amorphous resin, and the releasing agent.

13. The toner set for developing an electrostatic latent image according to claim 9, wherein the amorphous resin contained in each of the yellow toner, the magenta toner, the cyan toner, and the black toner comprises a styrene acrylic resin.

14. The toner set for developing an electrostatic latent image according to claim 9, wherein the carbon number of the linear chain aliphatic diol component forming the crystalline polyester resin contained in each of the yellow toner, the magenta toner, and the cyan toner is 4 or 5.

15. The toner set for developing an electrostatic latent image according to claim 9, wherein $C_{Ye}$, $C_{Ma}$, $C_{Cy}$ and $C_{Bk}$ satisfy the following formulas (1) to (3), wherein $C_{Ye}$ is the carbon number of the linear chain aliphatic diol component forming the crystalline polyester resin contained in the yellow toner, $C_{Ma}$ is the carbon number of the linear chain aliphatic diol component forming the crystalline polyester resin contained in the magenta toner, $C_{Cy}$ is the carbon number of the linear chain aliphatic diol component forming the crystalline polyester resin contained in the cyan toner, and $C_{Bk}$ is the carbon number of the linear chain aliphatic diol component forming the crystalline polyester resin contained in the black toner, $$1 \leq C_{Bk} - C_{Ye} \leq 6 \quad (1)$$

$$1 \leq C_{Bk} - C_{Ma} \leq 6 \quad (2)$$

$$1 \leq C_{Bk} - C_{Cy} \leq 6 \quad (3).$$

16. The toner set for developing an electrostatic latent image according to claim 9, wherein $C_{Ye}$, $C_{Ma}$, $C_{Cy}$ and $C_{Bk}$ satisfy the following formulas (4) to (6), wherein Cy, is the carbon number of the linear chain aliphatic diol component forming the crystalline polyester resin contained in the yellow toner, $C_{Ma}$ is the carbon number of the linear chain aliphatic diol component forming the crystalline polyester resin contained in the magenta toner, $C_{Cy}$ is the carbon number of the linear chain aliphatic diol component forming the crystalline polyester resin contained in the cyan toner, and $C_{Bk}$ is the carbon number of the linear chain aliphatic diol component forming the crystalline polyester resin contained in the black toner, $$2 \leq C_{Bk} - C_{Ye} \leq 4 \quad (4)$$

$$2 \leq C_{Bk} - C_{Ma} \leq 4 \quad (5)$$

$$2 \leq C_{Bk} - C_{Cy} \leq 4 \quad (6).$$

* * * * *